US011594096B2

(12) United States Patent
Einav et al.

(10) Patent No.: US 11,594,096 B2
(45) Date of Patent: *Feb. 28, 2023

(54) HANDLING MEDICATION RECEPTACLES BY PHARMACEUTICAL DISPENSING SYSTEM AND METHOD

(71) Applicant: Tech Pharmacy Services, LLC, Fort Lee, NJ (US)

(72) Inventors: Omer Einav, Kfar-Monash (IL); Doron Shabanov, Tzur-Yigal (IL); Tamir Ben David, Tel-Aviv (IL); Anthony Joseph Spero, Queensbury, NY (US); Eyal Livschitz, Givat Shmuel (IL); Thomas A. Mckinney, Boonton, NJ (US); Moshe Liberman, Yehud (IL)

(73) Assignee: Tech Pharmacy Services, LLC, Fort Lee, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/201,255

(22) Filed: Mar. 15, 2021

(65) Prior Publication Data

US 2021/0201618 A1 Jul. 1, 2021

Related U.S. Application Data

(63) Continuation of application No. 16/430,456, filed on Jun. 4, 2019, now Pat. No. 10,964,154.

(51) Int. Cl.

| | |
|---|---|
| ***G07F 11/44*** | (2006.01) |
| ***G07F 17/00*** | (2006.01) |
| ***A61J 7/00*** | (2006.01) |

(52) U.S. Cl.

CPC ..... *G07F 17/0092* (2013.01); *A61J 7/0076* (2013.01); *G07F 11/44* (2013.01)

(58) Field of Classification Search

CPC ..... A61J 7/0076

See application file for complete search history.

(56) References Cited

U.S. PATENT DOCUMENTS

| | | | |
|---|---|---|---|
| 5,405,048 | A | 4/1995 | Rogers et al. |
| RE35,743 | E | 3/1998 | Pearson |

(Continued)

FOREIGN PATENT DOCUMENTS

| | | |
|---|---|---|
| WO | WO 01/21131 | 3/2001 |
| WO | WO 2004/036481 | 4/2004 |

(Continued)

OTHER PUBLICATIONS

International Preliminary Report on Patentability dated Oct. 21, 2021 From the International Bureau of WIPO Re. Application No. PCT/IB2020/053082. (6 Pages).

(Continued)

*Primary Examiner* — Gene O Crawford
*Assistant Examiner* — Ayodeji T Ojofeitimi

(57) ABSTRACT

A medication dispensing system, having a medication panel, a plurality of docking ports for accommodating medication containers, a gripper, and a receptacle carrier having a mount for holding the receptacle and movable by one or more actuators. In some embodiments, the system includes control circuitry, outputting positioning signals to move the receptacle carrier, and outputting dosage-manipulation signals to move the gripper to pick and manipulate a medication dosage out of the medication container, and the horizontal distance between the opening of the receptacle and the medication dosage is less than 20 cm at least prior to outputting the dosage-manipulation signals. The method includes extracting a medication out of the medication container, positioning a receptacle by a receptacle carrier in a horizontal distance of less than 20 cm between the medi- (Continued)

cation and the opening of the receptacle, at least prior to the extracting, and dispensing the medication in the receptacle.

25 Claims, 16 Drawing Sheets

(56) References Cited

U.S. PATENT DOCUMENTS

| | | | |
|---|---|---|---|
| 6,006,946 | A | 12/1999 | Williams et al. |
| 6,529,801 | B1 | 3/2003 | Rosenblum |
| 7,698,019 | B2 | 4/2010 | Moncrief et al. |
| 8,027,849 | B2 | 9/2011 | Johnson et al. |
| 8,219,243 | B2 | 7/2012 | Haas |
| 8,280,550 | B2 | 10/2012 | Levy et al. |
| 8,521,327 | B2 | 8/2013 | Pinney et al. |
| 8,991,138 | B2 | 3/2015 | Yuyama et al. |
| 9,031,690 | B2 | 5/2015 | Cotner |
| 9,779,215 | B2 | 10/2017 | Rosenblum |
| 9,908,704 | B2 | 3/2018 | Hawkes et al. |
| 10,007,764 | B2 | 7/2018 | Kim |
| 10,049,188 | B2 | 8/2018 | Lantorno et al. |
| 10,614,916 | B1 | 4/2020 | Einav et al. |
| 10,959,917 | B2 | 3/2021 | Einav et al. |
| 10,964,154 | B2 | 3/2021 | Einav et al. |
| 2003/0024943 | A1 | 2/2003 | MacDonald |
| 2004/0155049 | A1 | 8/2004 | Float et al. |
| 2005/0049746 | A1 | 3/2005 | Rosenblum |
| 2005/0259818 | A1 | 11/2005 | Silverbrook et al. |
| 2009/0321469 | A1 | 12/2009 | Knoth |
| 2010/0300041 | A1 | 12/2010 | Kim |
| 2011/0017764 | A1 | 1/2011 | Liguori et al. |
| 2011/0251850 | A1 | 10/2011 | Stephens |
| 2011/0315588 | A1 | 12/2011 | Ross et al. |
| 2012/0004770 | A1 | 1/2012 | Ooyen et al. |
| 2012/0187141 | A1 | 7/2012 | Young et al. |
| 2012/0209619 | A1 | 8/2012 | Knotts et al. |
| 2012/0259458 | A1 | 12/2012 | Barrett et al. |
| 2013/0092700 | A1 | 4/2013 | Braunstein |
| 2013/0123977 | A1 | 5/2013 | Sanders et al. |
| 2013/0240555 | A1 | 9/2013 | Kim |
| 2014/0058555 | A1 | 2/2014 | Rhoads, Jr. et al. |
| 2014/0262690 | A1 | 9/2014 | Henderson et al. |
| 2015/0081326 | A1 | 3/2015 | Krishnapuram et al. |
| 2015/0154709 | A1 | 6/2015 | Cook |
| 2016/0068328 | A1 | 3/2016 | Lam et al. |
| 2016/0132404 | A1 | 5/2016 | Munson et al. |
| 2017/0132867 | A1 | 5/2017 | Berg et al. |
| 2017/0220768 | A1 | 8/2017 | Tanner, Jr. et al. |
| 2017/0267453 | A1 | 9/2017 | Hellenbrand |
| 2017/0312182 | A1* | 11/2017 | Ma ..... G07F 11/1657 |
| 2018/0122177 | A1 | 5/2018 | Este et al. |
| 2018/0357596 | A1 | 12/2018 | Bedford |
| 2020/0185076 | A1 | 6/2020 | Einav et al. |
| 2020/0323737 | A1 | 10/2020 | Einav et al. |
| 2020/0327980 | A1 | 10/2020 | Einav et al. |
| 2020/0388100 | A1 | 12/2020 | Einav et al. |
| 2020/0388369 | A1 | 12/2020 | Einav et al. |
| 2021/0205178 | A1 | 7/2021 | Einav et al. |
| 2021/0225479 | A1 | 7/2021 | Einav et al. |
| 2021/0366599 | A1 | 11/2021 | Einav et al. |
| 2022/0101976 | A1 | 3/2022 | Einav et al. |

FOREIGN PATENT DOCUMENTS

| | | |
|---|---|---|
| WO | WO 2005/043440 | 5/2005 |
| WO | WO 2018/052160 | 3/2018 |
| WO | WO 2020/121165 | 6/2020 |
| WO | WO 2020/208439 | 10/2020 |
| WO | WO 2020/208477 | 10/2020 |
| WO | WO 2020/208479 | 10/2020 |
| WO | WO 2020/245739 | 12/2020 |

OTHER PUBLICATIONS

International Preliminary Report on Patentability dated Jun. 24, 2021 From the International Bureau of WIPO Re. Application No. PCT/IB2019/060572. (8 Pages).
Applicant-Initiated Interview Summary dated Jul. 12, 2019 From the Re. U.S. Appl. No. 16/379,831. (3 pages).
Final Official Action dated May 14, 2020 from the Re. U.S. Appl. No. 16/214,081. (32 pages).
International Search Report and the Written Opinion dated Mar. 22, 2020 From the International Searching Authority Re. Application No. PCT/IB2019/060572. (14 Pages).
International Search Report and the Written Opinion dated Jun. 25, 2020 From the International Searching Authority Re. Application No. PCT/IB2020/052052. (10 Pages).
International Search Report and the Written Opinion dated Jun. 25, 2020 From the International Searching Authority Re. Application No. PCT/IB2020/053080. (13 Pages).
International Search Report and the Written Opinion dated Jun. 28, 2020 From the International Searching Authority Re. Application No. PCT/IB2020/053082. (13 Pages).
International Search Report and the Written Opinion dated Aug. 31, 2020 From the International Searching Authority Re. Application No. PCT/IB2020/055232.
Interview Summary dated Jul. 21, 2020 from the Re. U.S. Appl. No. 16/430,456. (3 pages).
Interview Summary dated Jan. 8, 2021 from the Re. U.S. Appl. No. 16/379,835. (4 pages).
Notice of Allowance dated Dec. 10, 2020 From the Re. U.S. Appl. No. 16/379,831. (18 Pages).
Notice of Allowance dated May 14, 2021 From the Re. U.S. Appl. No. 16/379,835. (14 Pages).
Official Action dated Aug. 5, 2019 From the Re. U.S. Appl. No. 16/379,831. (25 pages).
Official Action Dated Sep. 9, 2019 From the Re. U.S. Appl. No. 16/214,081. (33 pages).
Official Action dated May 15, 2019 From the Re. U.S. Appl. No. 16/379,831. (24 pages).
Official Action dated Jul. 17, 2020 from the Re. U.S. Appl. No. 16/559,716. (17 pages).
Official Action dated Jun. 25, 2020 from the Re. U.S. Appl. No. 16/430,456. (15 pages).
Official Action dated Nov. 25, 2020 From the Re. U.S. Appl. No. 16/379,835. (38 Pages).
Restriction Official Action dated Apr. 2, 2019 From the Re. U.S. Appl. No. 16/214,081. (6 pages).
Restriction Official Action dated Jul. 24, 2020 From the Re. U.S. Appl. No. 16/379,835. (6 Pages).
International Preliminary Report on Patentability dated Oct. 21, 2021 From the International Bureau of WIPO Re. Application No. PCT/IB2020/052052. (7 Pages).
International Preliminary Report on Patentability dated Oct. 21, 2021 From the International Bureau of WIPO Re. Application No. PCT/IB2020/053080. (7 Pages).
Final Official Action dated Aug. 23, 2021 from the Re. U.S. Appl. No. 16/737,943. (10 pages).
International Preliminary Report on Patentability dated Dec. 16, 2021 From the International Bureau of WIPO Re. Application No. PCT/IB2020/055232. (8 Pages).
Official Action dated Jun. 27, 2022 from Re. U.S. Appl. No. 17/207,796. (38 pages).
Supplementary European Search Report and the European Search Opinion dated Aug. 1, 2022 From the European Patent Office Re. Application No. 19896179.9. (8 Pages).

* cited by examiner

HANDLING MEDICATION RECEPTACLES BY PHARMACEUTICAL DISPENSING SYSTEM AND METHOD

RELATED APPLICATIONS

This application is a continuation of U.S. patent application Ser. No. 16/430,456 filed on Jun. 4, 2019.

The contents of the above application are all incorporated by reference as if fully set forth herein in their entirety.

FIELD AND BACKGROUND OF THE INVENTION

The present invention, in some embodiments thereof, relates to a medication dispensing system and, more particularly, but not exclusively, to handling and positioning of medication receptacles in a medication dispensing system.

US Patent Publication No. 2013/0123977 discloses "systems and methods for managing canisters used to automatically dispense medication. Canisters are configurable via a design process and a build process to accurately dispense a variety of medications. Design profiles are created and stored by a canister management system, and are federated to workstations used to build and fill the canisters, and to workstations used to dispense the medication. Information related to the build process, the fill process, and the dispense process is also federated by the system. The system also enables the transmission of other types of messages between client applications on the workstations and the canister management system. The system is useful to federate data regardless of a structure of a supply chain used to design, build, distribute, and use the canisters".

International Patent Publication No. WO 2018/052160 discloses "a medication dispenser having high space utilization, having a large quantity of medication packages loaded therein, having high medication-dispensing efficiency, and enabling smooth dispensing regardless of the size and type of the medication package. Provided is the medication dispenser comprising: a canister module in which a canister having the medication packages loaded therein is accommodated; and a pickup robot for picking up the medication packages in individual units, wherein the canister includes: L-shaped first and second walls for providing a loading space allowing the medication packages to move therein in the long axis direction of the canister; a guide for moving the first wall toward the second wall so as to adjust a gap with the second wall; a contact plate moving along the loading space, and bringing the medication packages into close contact with each other by pressure; and a spiral spring providing the pressure to the contact plate, having a strip shape, and wound in a coil shape".

US Patent Publication No. 2018/0122177 discloses "storage and distribution system for products in unit doses, including a plurality of housing units, each including a plurality of locations for products in unit doses. The housing units are organized on a vertical plane to produce at least one portion of a picking wall, in which the locations for products in unit doses face selective picking members. A picking unit includes picking members oriented on the picking wall for picking products packaged in unit doses. A collecting unit, arranged on a second side of the picking unit, includes a rack having a plurality of pegs facing towards the first side of the picking unit. The pegs are reached by the picking members so as to pick therefrom or deposit thereon products packaged in unit doses. The plurality of pegs as a whole can collect a smaller number of unit dose products than those that can be stored in the automatic store".

SUMMARY OF THE INVENTION

According to an aspect of some embodiments of the present invention there is provided a medication dispensing system, which inserts a probe to pick a medication dosage from a medication container, and dispenses the medication dosage into an opening in a medication receptacle. According to some embodiments, the system includes a medication panel, having a plurality of docking ports for accommodating the medication containers, one or more actuators, a gripper attachable to the probe or including the probe, a receptacle carrier comprising a receptacle mount for holding the receptacle, and movable by the one or more actuators. In some embodiments, the system includes control circuitry, outputting positioning signals to the one or more actuators to move the receptacle carrier, and outputting dosage-manipulation signals to the one or more actuators to move the gripper to pick and manipulate the medication dosage out of the medication container. In some embodiments, a horizontal distance between the opening of the receptacle and the medication dosage is less than 20 cm at least prior to outputting the dosage-manipulation signals.

According to some embodiments, the positioning signals maintain a horizontal distance of less than 20 cm between a projection of the opening of the receptacle and a projection of the medication container on a horizontal plane.

According to some embodiments, the dosage-manipulation signals manipulate the medication dosage in a medication path, between the medication container and the opening of the medication receptacles, having a total horizontal length of less than 20 cm.

According to some embodiments, the system includes a dispensing head, supporting the receptacle carrier to form a single unit that moves the receptacle together with the dispensing head. In some embodiments, the gripper is rotatably coupled to the dispensing head. In some embodiments, the dispensing head comprises a head housing, and a movable based platform rotatably coupled to the head housing. In some embodiments, the gripper is coupled to the base platform. In some embodiments, the gripper is linearly moveable in respect to the head housing.

According to some embodiments, the manipulation signals include rotating the gripper, between picking a medication dosage out of the medication container and positioning the medication dosage vertically above the opening of the receptacle.

According to some embodiments, the receptacles are medication envelopes, having an open state in which an upper side of the envelope is open for receiving medication dosage.

According to some embodiments, the system includes an envelope opener module having a manipulator, configured to open the envelope by coupling the manipulator to a face of the envelope.

According to some embodiments, the one or more actuators move the receptacle carrier vertically between the medication containers.

According to some embodiments, at said horizontal distance, there is an overlap between the projection of the opening of the receptacle and the projection of the medication dosage on a horizontal plane, so that the medication dosage falls into the opening when released from said probe. According to some embodiments, the one or more of the actuators or the dispensing head, actuate the receptacle carrier to move horizontally to be in a constant horizontal distance between the opening of the receptacle and the medication dosage.

According to some embodiments, the receptacle carrier is configured to hold more than one receptacle.

According to some embodiments, the receptacle is configured to accommodate one or more medication dosages.

According to some embodiments, the dispensing system comprises one or more output ports, and the receptacle carrier is movable to deliver the receptacle to the one or more output ports.

According to some embodiments, the dispensing system comprises a plurality of dispensing heads.

According to some embodiments, the dispensing system comprises a plurality of receptacle carriers.

According to some embodiments, the receptacle carrier is de-coupled of the dispensing head after dispensing the medication dosage in a receptacle.

According to some embodiments, there is an overlap between the projection of the opening of the receptacle and the projection of the medication container on a horizontal plane, between or during outputting the positioning signals and the dosage manipulation signals.

According to some embodiments, the receptacle carrier is coupled to the dispensing head at least prior to outputting dosage manipulation signals. In some embodiments, the receptacle carrier is coupled to the dispensing head prior to outputting approximating signals. In some embodiments, the receptacle carrier is coupled to the dispensing head after outputting approximating signals.

According to some embodiments, the control circuitry is configured to receive one or more parameters of the medication dosage, to process one or more velocity profiles defined according to the one or more parameters of the medication dosage. In some embodiment, the control circuitry outputs manipulation signals having one or more velocity profiles.

According to an aspect of some embodiments of the present invention there is provided a method for dispensing medications in receptacles, using a dispensing system, having a gripper module for pick a medication dosage from a medication container, and dispenses the medication dosage into an opening in a medication receptacle. According to some embodiments, the method includes extracting the medication dosage out of the medication container by the gripper module or by coupling the gripper module to a probe inserted in the medication container, positioning a receptacle by a receptacle carrier in a horizontal distance of less than 20 cm between the medication dosage and the opening of the receptacle, at least prior to the extracting, and dispensing the medication dosage in the receptacle.

According to some embodiments, the method includes locating the medication dosage to be vertically above the opening in the medication receptacle. According to some embodiments, the positioning comprises moving the receptacle carrier in respect to the gripper.

According to some embodiments, the method includes opening the receptacle prior to the dispensing. According to some embodiments, the method includes opening the receptacle between the positioning and the dispensing. According to some embodiments, the time between the extracting and the dispensing is less than 1 sec.

According to some embodiments, the method includes rotating the gripper module to align with a probe inserted within the medication container prior to the extracting.

According to some embodiments, the dispensing system includes a dispensing head supporting the gripper module, and the method includes coupling the receptacle carrier and the dispensing head prior to the extracting.

According to some embodiments, the positioning is prior to the extracting.

According to some embodiments, the positioning includes maintaining an overlap between the projection of the opening of the receptacle and the projection of the medication container on a horizontal plane.

According to some embodiments, the method includes approximating the gripping module to the medication container.

According to some embodiments, the method includes closing the receptacle after the dispensing.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

As will be appreciated by one skilled in the art, some embodiments of the present invention may be embodied as a system, method or computer program product. Accordingly, some embodiments of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, some embodiments of the present invention may take the form of a computer program product embodied in one or more computer readable medium(s) having computer readable program code embodied thereon. Implementation of the method and/or system of some embodiments of the invention can involve performing and/or completing selected tasks manually, automatically, or a combination thereof. Moreover, according to actual instrumentation and equipment of some embodiments of the method and/or system of the invention, several selected tasks could be implemented by hardware, by software or by firmware and/or by a combination thereof, e.g., using an operating system.

For example, hardware for performing selected tasks according to some embodiments of the invention could be implemented as a chip or a circuit. As software, selected tasks according to some embodiments of the invention could be implemented as a plurality of software instructions being executed by a computer using any suitable operating system. In an exemplary embodiment of the invention, one or more tasks according to some exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

Any combination of one or more computer readable medium(s) may be utilized for some embodiments of the invention. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium and/or data used thereby may be transmitted using any appropriate medium, including but not limited to wireless, wireline, optical fiber cable, RF, etc., or any suitable combination of the foregoing.

Computer program code for carrying out operations for some embodiments of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Some embodiments of the present invention may be described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Some of the methods described herein are generally designed only for use by a computer, and may not be feasible or practical for performing purely manually, by a human expert. A human expert who wanted to manually perform similar tasks, such as positioning medication receptacles in respect to a medication picking probe and dispensing medication dosage in proximity to a medication container in a dispensing system, might be expected to use completely different methods, e.g., making use of expert knowledge and/or the pattern recognition capabilities of the human brain, which would be vastly more efficient than manually going through the steps of the methods described herein.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
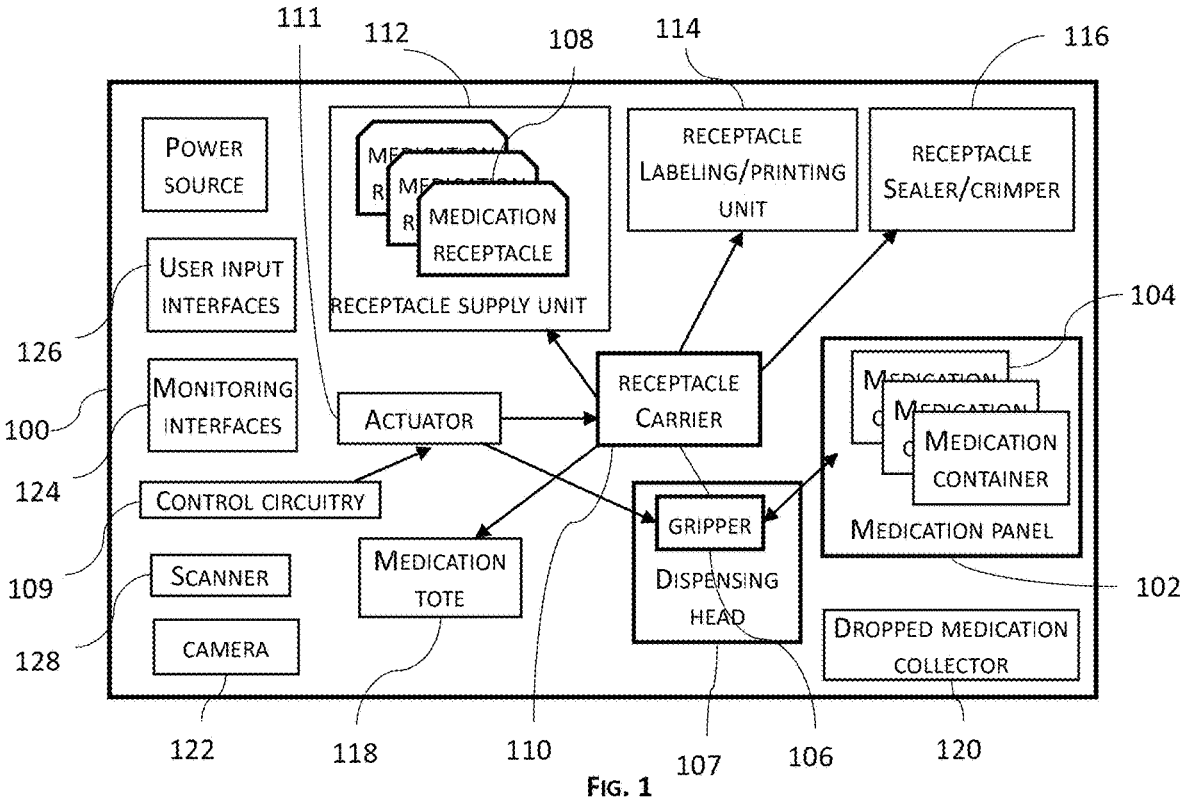
FIG. 1 is a simplified illustration of a block diagram of a pharmaceutical dispensing system, according to some embodiments of the invention.

The present invention, in some embodiments thereof, relates to a medication dispensing system and, more particularly, but not exclusively, to handling and positioning of medication receptacles in a medication dispensing system.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Overview

A broad aspect of some embodiments of the invention relates to a medication dispensing system for extracting medication dosage out of medication containers and dispensing the medication dosage in receptacles provided to the system.

According to some embodiments, the dispensing system has interior arrangement and interactions to affect operational parameters of a medication dispensing system. In some embodiments, the dispensing system has control circuitry and actuators electrically connected to the control circuitry that defines operational parameters of the medication dispensing system. In some embodiments, the operational parameters include minimizing the movements of the medication dosage. In some embodiments, the operational parameters include moving the medication dosage in short movements after being extracted from medication container and prior to being disposed into a receptacle.

An aspect of some embodiments of the invention relates to reducing accidental disposing of medication dosage outside medication receptacles in a medication dispensing system that extracts medication dosage out of medication containers and dispenses the medication dosage in medication receptacles.

According to some embodiments, the dispensing system is structured to have short the movements of medication dosage to reduce an accidental loosing of the extracted medication dosage prior to the dispensing of the medication dosage inside the medication receptacle.

According to some embodiments the medication dispensing system has a gripper for picking the medication dosage, and the dispensing system keeps the movements of the medication dosage to be minimal by positioning the medication receptacles in proximity to the gripper. In some embodiments, dispensing system positions the medication receptacles in proximity to the gripper between the receiving of the medication dosage out of the container and the dispensing of the medication dosage into the medication receptacles.

According to some embodiments, the system includes control circuitry that controls the movements of the medication dosage. In some embodiments, the control circuitry outputs signals to one or more actuators that manipulate the medication dosage in a medication path, between the medication container and the receptacle, having a total horizontal length (defined as the projection of the medication path on a horizontal plane) of less than 20 cm.

A potential advantage in keeping the receptacles in proximity to the gripper is reducing the length and time the medication dosage travels outside the medication container.

An aspect of some embodiments of the invention relates to a medication dispensing system, having a safe destination for a medication dosage during a dispensing process.

According to some embodiments, the dispensing system has a receptacle carrier for carrying the medication receptacles and keeping the receptacles in proximity to the medication dosage. In some embodiments, the medication receptacles have an opening acting as a funnel for receiving the medication dosage. In some embodiments, the horizontal distance between the medication dosage and the opening of the receptacle is kept to be less than 20 cm between the receiving and the dispensing of the medication dosage. In some embodiments, the horizontal distance between the medication dosage and the opening of the receptacle is defined as the maximal distance between the projection of the medication dosage on a horizontal plane and the projection of the opening of the receptacle on a horizontal plane.

In some embodiments, the receptacle carrier holds and positions the opening of the medication receptacle in a horizontal distance of less than 20 cm between the receiving and the dispensing of the medication dosage. In some embodiments, the receptacle carrier holds and positions the opening of the medication receptacle vertically below the medication dosage between the receiving and the dispensing of the medication dosage.

According to some embodiments the medication dispensing system has a gripper for picking medication dosage. In some embodiments, the medication dispensing system has one or more actuators for moving the gripper. In some embodiments, the actuators position the gripper in proximity to a medication container prior to extracting a medication dosage by the gripper. In some embodiments, the dispensing system couples the gripper to a probe inserted in the medication containers for picking the medication dosage out of the medication container.

According to some embodiments, the dispensing system includes a dispensing head and the gripper is coupled to the dispensing head. In some embodiments, the gripper is movably coupled to the dispensing head. In some embodiments, the gripper is rotatable coupled to the dispensing head. In some embodiments, the actuators move the dispensing head to position the gripper in respect to the medication container. In some embodiments, the actuators move the dispensing head to position the gripper in respect to the receptacle.

In some embodiments, the receptacle carrier is coupled to the dispensing head, so that the receptacle is moving together with the dispensing head. In some embodiments, the receptacle carrier is coupled to the dispensing head prior to picking a medication dosage and at least until dispensing of the medication into the receptacle. In some embodiments, the dispensing head and the receptacle carrier are a single unit.

In some embodiments, the medication receptacles are medication envelopes.

In some embodiments, the probe is used for picking medication dosage out of the containers, and for dispensing the medication. In some embodiments, the probe is coupled to the medication containers and extracting medication dosage is by grabbing the probe out of the container by the gripper. In some embodiments, dispensing of the medication dosage is by dropping it from the gripper or probe to the opening of the receptacle positioned below the gripper.

According to some embodiments, there is a horizontal overlap between a projection of the opening of the receptacle and a projection of the medication container on a horizontal plane. In some embodiments, the receptacle is positioned below the probe in a horizontal distance of less than 20 cm between picking of the probe and dispensing the medication. In some embodiments, the time between the picking of the probe out of the container and the dispensing of the medication dosage is shorter than 10 sec.

A potential advantage is reducing accidental loosing of the medication dosage from the probe prior to dispensing the medication dosage. Another potential advantage is that the time the medication container is left open when probe is removed from the container is minimized.

An aspect of some embodiments of the invention relates to a medication dispensing system, which extracts a medication dosage out of medication containers and dispenses the medication dosage via an opening formed in medication envelopes during the dispensing process.

According to some embodiments, the dispensing system has an envelope opener module that opens the medication envelopes at a specific period during the dispensing process. In some embodiments, the envelope opener module opens the envelope between the extracting of the medication dosage and the dispensing of the medication dosage.

According to some embodiments, multiple medication dosages can be dispensed within a single envelope. In some embodiments, when the envelope is not open, it is kept closed to avoid contamination of medication within the envelope.

According to some embodiments, the system includes envelope carrier, configured to hold and to open the medication envelope. In some embodiments, the system has control circuitry and one or more actuators, and control circuitry outputs signals to the one or more actuators to actuate the carrier to open the envelope. In some embodiments, the envelope opener module is coupled to the envelope carrier.

An aspect of some embodiments of the invention relates to a medication dispensing system, having a control circuitry outputting signals to actuate one or more actuators to manipulate a medication dosage, between picking of the medication dosage out of a medication container and dispensing the dosage in a medication receptacle.

According to some embodiments, the control circuitry processes the timing of the signals and the value of the signal in accordance to one or more medication parameters. In some embodiments, the signals include one or more velocity profiles. In some embodiments, the signals include one or more acceleration values. In some embodiments, the signals include the length and the direction of the movements. Some examples of the medication parameters are weight, type, shape, and cost. In some embodiments, control circuitry includes storage for storing historical data such as medication parameters, velocity profiles, and success/failure rate of dispensing medication dosage having velocity profile selected according to the medication parameters.

U.S. patent application Ser. No. 16/379,835 discloses a modular pharmaceutical dispensing machines configured to perform at least a part of a pharmaceutical dispensing process, having pharmaceutical array module(s) and mechanical arm module(s). The dispensing system having the dispensing modules for extracting and dispensing medication in receptacles described elsewhere herein can be part of the machine disclosed in application Ser. No. 16/379,835.

U.S. patent application Ser. No. 16/214,081 discloses a system of pharmaceutical dispensing for at least one facility, having a dispensing machine positioned in the facility. The dispensing system and method having the dispensing modules and circuitry for extracting and dispensing medication in receptacles described elsewhere herein can be a component in the dispensing machine and system disclosed in application Ser. No. 16/214,081.

Patent application Ser. Nos. 16/214,081 and 16/379,835 are herein incorporated in their entirety by reference into the specification, to the same extent as if each individual publication, patent or patent application was specifically and individually indicated to be incorporated herein by reference.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Medication Dispensing System

Referring now to FIG. 1, which is a simplified illustration of a block diagram of a pharmaceutical dispensing system, according to some embodiments of the invention.

As shown in FIG. 1, medication dispensing system 100 includes one or more medication panels 102 for accommodating a supply of medications. According to some embodiments, medication is stored in medication containers 104. In some embodiments, medication panels 102 have a plurality of docking ports for coupling medication containers 104 to panels 102.

Dispensing system 100 has a dispensing gripper 106 configured to receive a medication dosage from medication containers 104 and to hold the medication dosage until disposing the medication dosage in a medication receptacle 108. According to some embodiments, gripper 106 is configured to move next to panel 102 and approximate a container 104 for receiving a medication dosage. In some embodiments, dispensing system 100, has a plurality of grippers 106. In some embodiments, dispensing gripper 106 is configured to dispense medication dosage in a plurality of medication receptacles 108.

According to some embodiments, dispensing system 100 dispenses the medication dosage by dropping the medication dosage into medication receptacles 108 positioned under dispensing gripper 106. In some embodiments, dispensing system 100 moves gripper 106 above medication receptacles 108 to allow dropping the medication dosage into medication receptacles 108. In some embodiments, dispensing system 100 moves medication receptacles 108 under gripper 106 to allow dropping the medication dosage into medication receptacles 108. In some embodiments, disposing of the medication dosage is by manipulating the medication dosage into receptacles 108 positioned in proximity to dispensing gripper 106.

As shown in FIG. 1, dispensing system 100 includes one or more receptacle carriers 110 for manipulating one or more medication receptacles 108 having an opening for receiving medication dosage. In some embodiments, receptacle carrier 110 is manipulating medication receptacles 108 to follow the position of dispensing gripper 106. In some embodiments, receptacle carrier 110 is manipulating medication receptacles 108 to have its opening located vertically beneath dispensing gripper 106 in a horizontal distance of less than 30 cm. In some embodiments, receptacle carrier 110 is manipulating medication receptacles 108 to have its opening located vertically beneath dispensing gripper 106 in a horizontal distance of less than 20 cm. In some embodiments, receptacle carrier 110 is manipulating medication receptacles 108 to have its opening located vertically beneath dispensing gripper 106 in a horizontal distance of less than 10 cm. In some embodiments, there is an overlap between a projection of the opening of receptacle 108 and a projection of the medication dosage on a horizontal plane, so that the medication dosage falls into the opening of receptacle 108 when released from gripper 106. In some embodiments, there is an overlap between the projection of the opening of receptacle 108 and the projection of container 104 on a horizontal plane.

A potential advantage in moving medication receptacles 108 in proximity to dispensing gripper 106 is reducing the length and time gripper 106 travels with a medication dosage for dispensing the dosage into receptacle 108. Another potential advantage is reducing the risk of losing medication dosage between receiving the dosage out of container 104 and dispensing into receptacle 108. For example, an overlap can increases the potential of receiving a medication dosage by receptacle 108 if medication dosage falls or released from gripper 106.

In some embodiments, gripper 106 does not move horizontally towards receptacle 108 after receiving the medication dosage. A potential advantage of reducing the horizontal movements is reducing the medication dispensing time to increase the medication packaging rate. Another potential advantage is reducing the risk of losing medication dosage from gripper 106.

According to some embodiments, dispensing system 100 includes control circuitry 109 that outputs actuation signal to actuate gripper 106 and receptacle carrier 110. In some embodiments, system 100 actuates gripper 106 and receptacle carrier 110 using one or more actuators 111 receiving actuating signals from circuitry 109.

According to some embodiments, control circuitry 109 outputs approximating signals to actuators 111 to move gripper 106 to approximate medication container 104. In some embodiments, control circuitry 109 outputs dosage manipulation signals to actuators 111 to move gripper 106 to manipulate medication dosage out of medication container 104. In some embodiments, control circuitry 109 outputs positioning signals to actuators 111 to move gripper 106 to position the opening of receptacle 104 in a horizontal distance of less than 30 cm from the medication dosage. In some embodiments, control circuitry 109 outputs positioning signals between or during the approximating signals and the dosage manipulation signals.

According to some embodiments, multiple medication dosages can be dispensed within a single medication receptacle 108. A potential advantage in dispensing multiple medication dosages in a single medication receptacle 108 is reducing the travel of gripper 106 and/or carrier 110 to collect receptacles and/or deliver packaged receptacles. Another potential advantage is reducing the number of receptacles packaged per patient.

According to some embodiments, receptacle carrier 110 is movable independently of gripper 106. In some embodiments, dispensing system 100 has one or more carrier actuators 111 that move receptacle carrier 110. In some embodiments, carrier actuators move receptacle carrier 110 linearly. In some embodiments, carrier actuators move carrier 110 parallel to panel 102. In some embodiments, moving receptacle carrier 110 is synchronous with moving of gripper 106.

According to some embodiments, dispensing system 100 includes a dispensing head 107 and gripper 106 is coupled to dispensing head 107. In some embodiments gripper 106 is movably coupled to dispensing head 107. In some embodiments, gripper 106 is rotatable coupled to dispensing head 107. In some embodiments, actuators 110 move dispensing head 107 to position gripper 106 in respect to medication container 104. In some embodiments, actuators 110 move dispensing head 107 to position gripper 106 in respect to receptacle 108.

According to some embodiments, dispensing system 100 is structured to move receptacle carrier 110 together with dispensing head 107. In some embodiments, receptacle carrier 110 is configured to be attached to head 107 prior to dispensing medication. In some embodiments, receptacle carrier 110 is configured to be attached to head 107 prior to approximating container 104. In some embodiments, receptacle carrier 110 is configured to be attached to head 107 prior to picking medication dosage by gripper 106. In some embodiments, receptacle carrier 110 is configured to be attached to head 107 prior to dispensing medication dosage. In some embodiments, attaching carrier 110 to head 107 is by moving head 107 towards receptacle carrier 110. In some embodiments, attaching carrier 110 to head 107 is by moving receptacle carrier 110 towards head 107. In some embodiments, carrier 110 and head 107 are part of one unit.

According to some embodiments, receptacle carrier 110 is configured to carry one or more medication receptacles 108. In some embodiments, receptacle carrier 110 receives and holds medication receptacles 108 prior to dispensing medication dosage. In some embodiments, receptacle carrier 110 receives and holds medication receptacles 108 prior to extracting medication dosage from medication containers 104.

In some embodiments, control circuitry 109 outputs positioning signals to actuators 111 to move receptacle carrier 110 to position the opening of receptacle 104 in a horizontal distance of less than 20 cm from the medication dosage. In some embodiments, the horizontal distance is less than 10 cm from the medication dosage. In some embodiments, the horizontal distance is less than 5 cm from the medication dosage. In some embodiments, the horizontal distance between the medication dosage and the opening of the receptacle 104 is defined as the maximal distance between the projection of the medication dosage on a horizontal plane and the projection of the opening of the receptacle 104 on a horizontal plane.

In some embodiments, control circuitry 109 outputs positioning signals to actuators 111 to move receptacle carrier 110 between medication containers 104. In some embodiments, control circuitry 109 outputs positioning signals between or during the approximating signals and the dosage manipulation signals. In some embodiments, moving receptacle carrier 110 between medication containers 104 is defined as a movement of a receptacle 108 from being positioned in proximity to one container 104 to being positioned in proximity to another container 104. In some embodiments, the movement of a receptacle 108 between containers is horizontal. In some embodiments, the movement of a receptacle 108 between containers 104 is vertical. In some embodiments, the movement of a receptacle 108 between containers 104 is without increasing the distance of receptacle 108 from panel 102. According to some embodiments, medication receptacles 108 are medication envelopes. In some embodiments, medication receptacles 108 have 3D geometry, such as rectangular box, cylindrical, conical, etc. In some embodiments, medication receptacles 108 are rigid like plastic canister. In some embodiments, medication receptacles 108 are non-rigid like plastic, nylon bag, and paper.

According to some embodiments, dispensing system 100 includes one or more receptacle supply units 112 for storing receptacles 108. In some embodiments, carrier 110 is configured to acquire receptacles 108 from receptacle supply unit 112. In some embodiments, supply unit 112 is loaded with receptacles 108 of different sizes. In some embodiments, the dispensing system 100 has a plurality of supply unit 112 fitted to accommodate receptacles 108 of different types as described elsewhere herein.

According to some embodiments, dispensing system 100 has a labeling or printing unit 114 for labeling medication receptacles 108 with information related to medications disposed in receptacle 108, e.g. patient information, medication dosage information, time, etc. In some embodiments, printing unit 114 is configured to print on a surface of receptacle 108. In some embodiments, labeling medication receptacles 108 by placing a sticker on a surface of receptacles 108.

According to some embodiments, dispensing system 100 has a receptacle sealer 116. In some embodiments, when receptacles 108 are envelopes, sealer 116 can be a crimping device. In some embodiments, sealer 116 is a device configured for closing receptacles 108 by a lid/cover.

According to some embodiments, dispensing system 100 has one or more output ports for accommodating medication receptacles 108 after having medication dosage. According to some embodiments, one or more of the output ports are in the form of medication totes 118 for accommodating medication receptacles 108 after having medication dosage. In some embodiments, one or more of the output ports are PRN outputs for providing medication not through medication totes 118.

Figure 2:
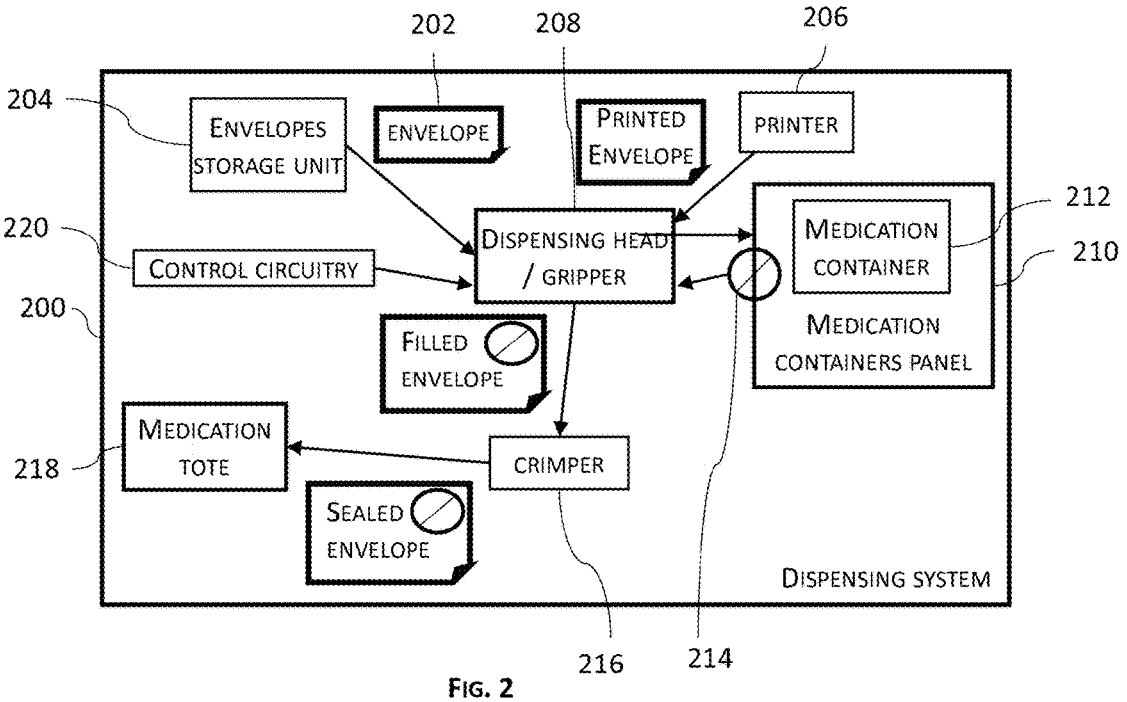
FIG. 2 is a simplified illustration of a block diagram of a pharmaceutical dispensing system, according to some embodiments of the invention.

Turning to FIG. 2, which is a simplified block diagram of modules of the dispensing system that participate in handling medication receiving envelopes, according to some embodiments of the invention.

As shown in FIG. 2, dispensing system 200 has one or more envelope storage units 204 for storing medication envelopes 202.

According to some embodiments, system 200 comprises a label printer 206 configured to print on envelope 202. In some embodiments, printer 206, prints on envelope 202 information related to medication dosages disposed therein.

According to some embodiments, system 200 comprises a dispensing head 208 configured to receive and hold envelopes 202 during the dispensing operation. In some embodiments, dispensing head 208 includes an envelope carrier to receive and hold envelopes 202. In some embodiments, dispensing head 208 receives and hold envelopes 202 by coupling head 208 and envelope carrier.

According to some embodiments, the dispensing head 208 is configured for picking a medication dosage 214 from a medication container 212 located within a medication containers panel 210. In some embodiments, dispensing head 208 includes a gripper to pick medication dosage 214 from a medication container 212. In some embodiments, one or more envelopes 202 are coupled to dispensing head 208 prior to picking medication dosage 214. In some embodiments, the envelopes 202 are coupled to a lower portion of the dispensing head 208 when disposing medication dosage 214 in envelope 202, such as medication dosage 214 are dispensed by dropping medication dosage 214 from a higher portion of head 208 into envelope 202 located at the lower portion. In some embodiments, envelope 202 is positioned under the gripper prior to dropping medication dosage 214 from the gripper into envelope 202.

According to some embodiments, envelope 202 has an open state in which the volume of envelope 202 is expanded to allow inserting dosage 214 into the envelope. In some embodiments, head 208 is configured to modify the state of envelope 202 to an open state. In some embodiments, an envelope carrier coupled to head 208 sets the state of envelope 202. In some embodiments, opening of envelope 202 is after envelope 202 is coupled to head 208. In some embodiments, head 208 opens envelope 202 prior to disposing medication dosage 214. In some embodiments, at least 90% of the projection of the receptacle at an open state on a horizontal plane is a funnel for medication dosage, and when a medication dosage is dropped into that projection, the medication dosage will be funneled into the receptacle.

According to some embodiments, dispensing system 200 has a control circuitry 220 that controls the movements and operation of dispensing head 208. In some embodiments, control circuitry 220 controls the setting the state of envelope 202. In some embodiments, control circuitry 220 actuates head 208 to set envelope 202 to an open state. In some embodiments, control circuitry 220 actuates head 208 to couple envelope 202 to head 208. In some embodiments, control circuitry 220 actuates head 208 to pick a medication dosage 214 from a medication container 212 by outputting dosage manipulation signals. In some embodiments, control circuitry 220 actuates head 208 to dispose medication dosage 214 in envelope 202, by outputting dispensing signals.

According to some embodiments, system 200 comprises a crimper 216, which receives and seals envelope 202 after being filled with medication dosage 214. In some embodiments, envelope 202 has a closed state in which envelope 202 is flat, having its volume in minimal state. In some embodiments, holding envelope 202 in an open state is terminated prior to receiving envelope 202 by crimper 216.

According to some embodiments, system 200 comprises one or more medication totes 218, to receive and store the sealed envelopes 202. In some embodiments, facility personnel unload envelopes 202 from medication totes 218 in order to distribute the medications packaged in envelopes 202.

Dispensing Process

Referring now to FIGS. 3A-3D, which are simplified flow charts illustrating the dispensing process, according to some embodiments of the invention. Some of the differences between the dispensing processes described in FIGS. 3A-3D are: the ways the receptacles are positioned in proximity to the dispensing gripper, the order some of the actions, and optional actions such as dispensing multiple dosages in a receptacle that can be added to any one of the dispensing processes.

According to some embodiments, the dispensing process can be divided into the following categories of activities:

Pre-dispensing activities, such as: providing a medication receptacle, and positioning the receptacle in proximity to the dispensing gripper.

Dispensing activities, such as: extracting medication dosage, and dispensing medication in the receptacle. In some embodiments, the dispensing steps can be repeated. For example, when multiple dosages are dispensed in a single or multiple receptacles.

Post-dispensing activities, such as: sealing the receptacles, and placing the receptacles in a collection unit/medication tote.

Pre-Dispensing Activities

Coupling a Medication Receptacle to a Dispensing Head—

Figure 3A:
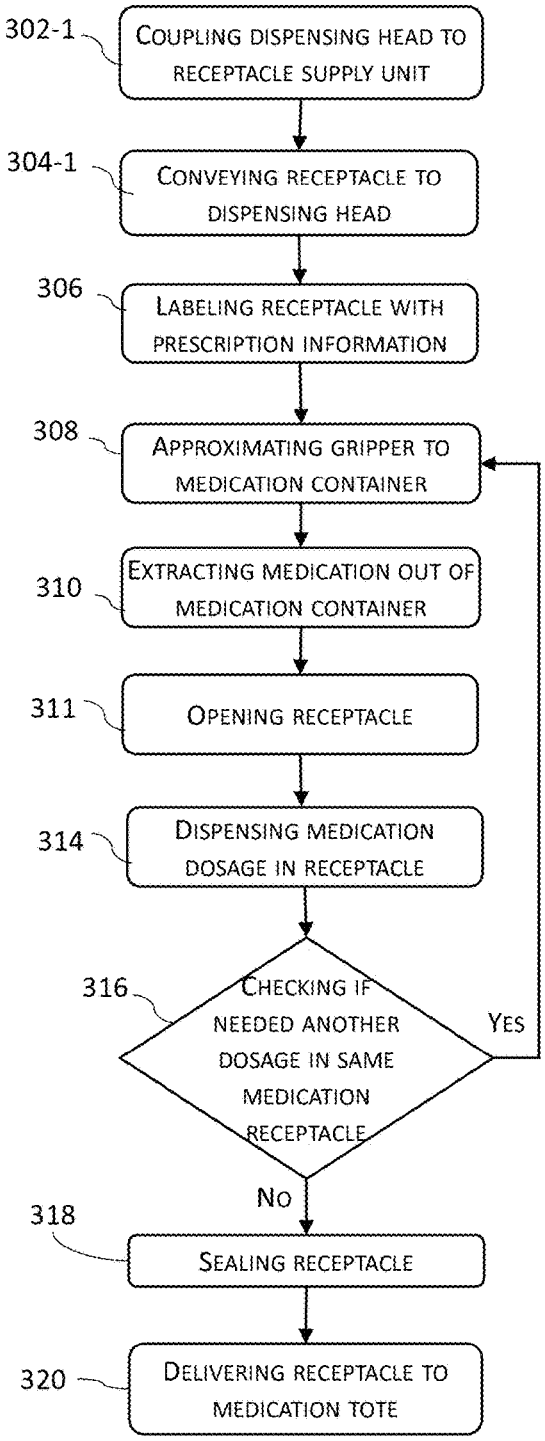
FIGS. 3A-3D are simplified flow charts illustrating dispensing process, according to some embodiments of the invention.
Figure 3B:
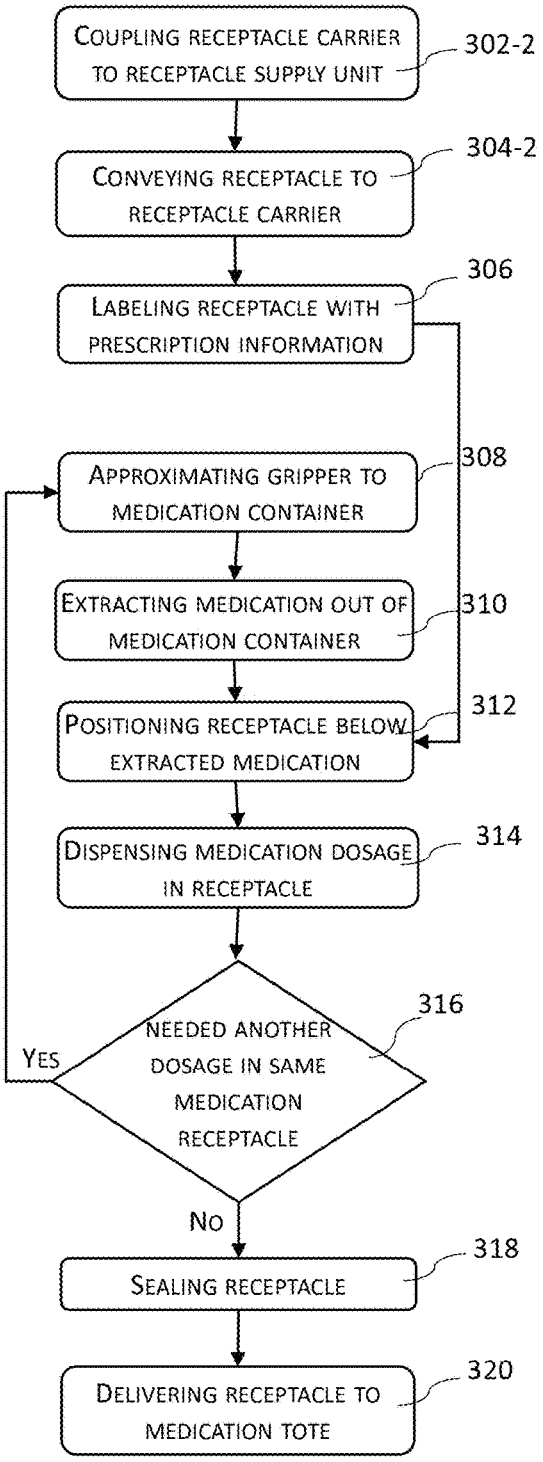
Figure 3C:
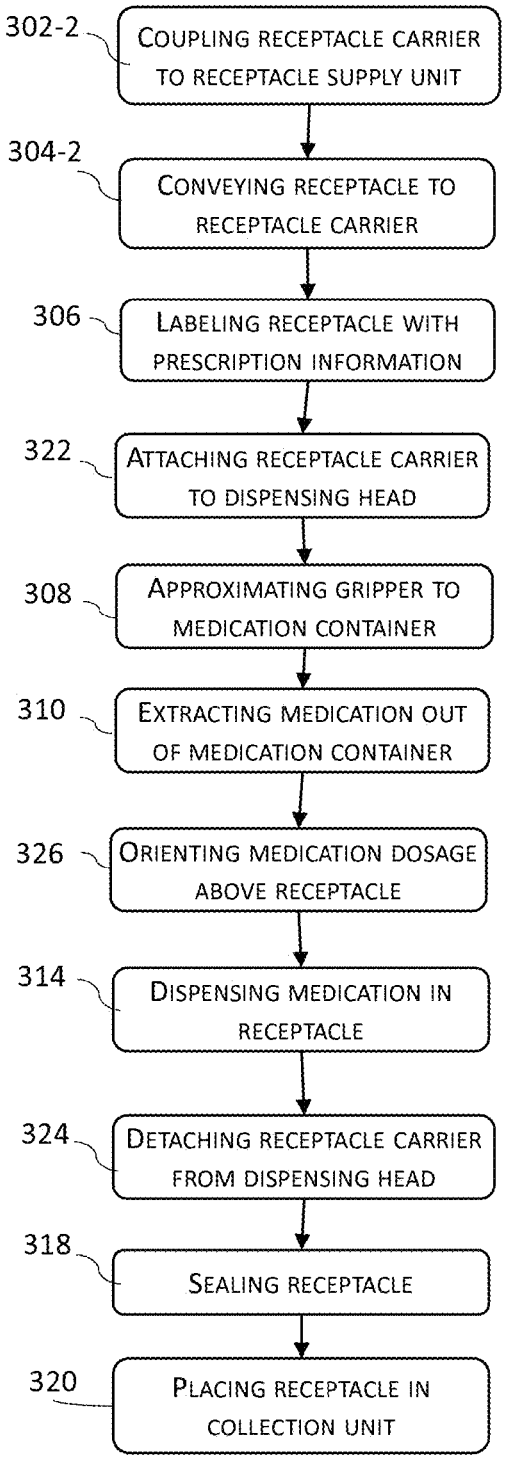
Figure 3D:
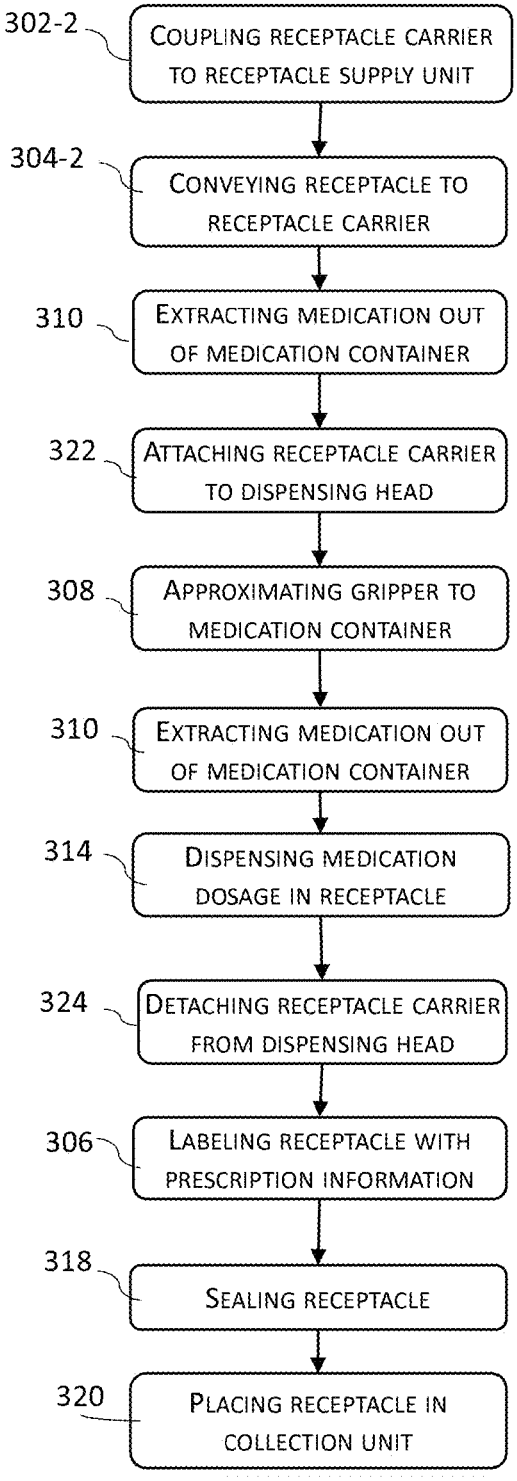

According to some embodiments, for example as show in in FIGS. 3A, 3C, and 3D, the medication receptacle (e.g. 108) is coupled to a dispensing head (e.g. 107) having a gripper (e.g. 106) prior to the dispensing of medication dosage. A potential advantage of coupling the medication receptacles to the dispensing head prior to dispensing, is reducing the travel of the gripper during the dispensing process.

As shown in FIG. 3A, according to some embodiments, providing a medication receptacles includes the following steps:

Coupling 302-1 the dispensing head (e.g. 107) to a receptacle supply unit (e.g. 112); and Conveying 304-1 a receptacle (e.g. 108) from receptacle supply unit (e.g. 112) to the dispensing head.

As shown in FIGS. 3C and 3D, according to some embodiments, providing a medication receptacles is by attaching a receptacle carrier (110) to the dispensing head (107) and includes the following steps:

Coupling 302-2 the receptacle carrier to receptacle supply unit for receiving a receptacle;

Conveying 304-2 the receptacle to receptacle carrier; and

Attaching 322 the receptacle carrier to the dispensing head.

Positioning the Gripper Next to Medication Container—

As shown in FIGS. 3A-3D, the dispensing process includes approximating 308 the gripper to a medication container (such as 104) within medication containers panel (such as 102).

According to some embodiments, approximating is by a linear movement of the gripper. In some embodiments, the linear movement is in a vertical direction. In some embodiments, the linear movement is in one or more horizontal directions. In some embodiments, the linear movement is a combination of horizontal and vertical movements. In some embodiments, the linear movements include movements which are angular to the medication container.

According to some embodiments, approximating is by control circuitry (e.g. 109), outputting approximating signals to one or more actuators (e.g. 111) to move the gripper to approximate the medication container.

According to some embodiments, for example such as shown in FIG. 3B, one or more of the receptacle preparation steps, such as coupling 302-2, conveying 304-2, and labeling 306, can be performed in parallel to one or more activities performed by the dispensing head or gripper, such as approximating 308 and extracting 310. A potential advantage in performing receptacle preparation step in parallel to dispensing head or gripper activities is increasing dispensing rate.

Dispensing Activities—

Receiving and Holding Medication Dosage

As shown in FIGS. 3A-3D, after dispensing gripper is positioned next to a medication container that contains a targeted medication, the gripper is receiving and holding a medication dosage. As shown in FIGS. 3A, 3C, and 3D, according to some embodiments, the medication receptacle is coupled to the dispensing head prior to the step of receiving/extracting a medication dosage.

According to some embodiments, receiving the medication is by extracting 310 the medication dosage out of the medication container. In some embodiments, extracting 310 is by providing suction through an extraction probe. In some embodiments, extracting is by gripping a medication dosage. In some embodiments, extracting includes lifting an extraction probe out of the medication container.

According to some embodiments, extracting 310 include outputting dosage manipulation signals by control circuitry to one or more actuators to move one or more of the dispensing head and the gripper to manipulate the medication dosage out of the medication container. In some embodiments, the signals include one or more velocity profiles. In some embodiments, the signals include one or more acceleration profiles. In some embodiments, the signals include the length and the direction of the movements. In some embodiments, outputting the dosage manipulation signals is preceded by receiving one or more parameters of the medication dosage, and processing one or more velocity profiles according to the one or more parameters of the medication dosage. Some examples of the medication parameters are: weight, type, shape, and cost. In some embodiments, the processing of the velocity profiles includes processing of historical data such as medication parameters, velocity profiles, and success/failure rate of dispensing medication dosage having velocity profile selected according to medication parameters.

As shown in FIG. 3C, the dispensing process includes orienting 326 the medication dosage to be located above the medication receptacle prior to dispensing into the receptacle. In some embodiments, orienting 326 include orienting the extraction probe. In some embodiments, the distance between the dispensing head and the medication container does not change during orienting 326. In some embodiments, there is no linear movement of the gripper in a horizontal direction away of the container between extracting and dispensing.

As shown in FIG. 3B, the dispensing process includes positioning 312 a receptacle below the extracted medication dosage. In some embodiments, positioning 312 applies when receptacle is not earlier coupled to dispensing head prior to extracting medication dosage. In some embodiments, positioning 312 applies when the dispensing system includes a receptacle carrier configured to move independently of the dispensing without coupling the receptacle to the dispensing head prior to extracting medication dosage. In some embodiments, positioning 312 is of the opening of the receptacle below the extracted medication dosage.

According to some embodiments, positioning 312 include outputting positioning signals by the control circuitry to one or more actuators to move one or more of: the dispensing head, the gripper, and the receptacle carrier, to position the opening of the receptacle in a horizontal distance of less than 20 cm from the medication dosage between or during the approximating 308 and extracting 310. In some embodiments, the horizontal distance is less than 10 cm. In some embodiments, the horizontal distance is less than 5 cm. In some embodiments, the horizontal distance is less than 50 cm.

According to some embodiments, for example, when receptacle is an envelope (e.g. 202), the dispensing process includes opening 311 receptacle to an open state. In some embodiments, opening 311 is for expanding the volume of a receptacle envelope to allow inserting medication dosage. In some embodiments, for example as shown in FIG. 3A, opening 311 is between extracting 310 and dispensing 314. In some embodiments, opening 311 is after positioning 312. Opening 311 is exemplified in FIG. 3A, however, it can apply to the flows described in any one of FIGS. 3B-3D, or other embodiments, not described in FIGS. 3A-3D.

As shown in FIGS. 3A-3D, the dispensing process includes dispensing 314 the medication dosage in the medication receptacle (e.g. 108).

In some embodiments dispensing 326 is by dropping medication dosage directly from the medication container into the receptacle through a dispensing port in the container.

In some embodiments, when medication is held by the dispensing gripper using suction, dispensing in by reducing the suction and dropping dosage into the receptacle.

According to some embodiments, for example as shown in FIGS. 3A and 3B, dispensing 314 is following by the optional step of checking 316 if additional dosage is required to be dispensed in the same receptacle. In some embodiments, checking 316 is an optional step in other flow options of the dispensing process, such as these shown in FIGS. 3C and 3D.

Post-Dispensing Activities

According to some embodiments, having a probe picked out of a medication container, the post-dispensing activities include returning the probe to the medication container. In some embodiments, returning of the probe includes re-orienting and inserting the probe into the medication container. In some embodiments the distance between the dispensing head and the medication container does not change during re-orienting and inserting. According to some embodiments, there is no linear movement of the dispensing gripper between approximating 308 to a medication container and inserting the probe into the medication container. In some embodiments, there is no linear movement of the dispensing gripper in a vertical direction between approximating 308 and inserting. In some embodiments, there is no linear movement of the dispensing gripper in a horizontal direction between approximating 308 and inserting.

According to some embodiments, a receptacle having a medication dosage is sealed and delivered to a receptacle collection zone. Some of the post-dispensing activities include:

Sealing 318 the medication receptacle after being filled with medication dosage. According to some embodiments, sealing 318 include covering the receptacle). In some embodiments, covering is by a lid.

In some embodiments, the receptacle is a medication envelope (e.g. 202) and sealing 318 is by crimping the envelope. In some embodiments, post-dispensing activities include closing the envelope to be flat with minimal volume. In some embodiments, closing the envelope is by terminating a force which holds the envelope in an open state is terminated. In some embodiments, closing the envelope is prior to receiving the envelope by the crimper.

Placing 320 the medication receptacles filled with a medication dosage in the collection unit/medication tote. In some embodiments, placing 320 is followed by delivering the medication receptacles to patients.

According to some embodiments, the dispensing process includes labeling 306 the receptacle with prescription information. Labeling 306 can be a pre-dispensing step, a dispensing steps, or a post-dispensing step. In some embodiments, for example as shown in FIG. 3C, labeling 306 is performed prior to attaching 322 to the dispensing head. In some embodiments, for example as shown in FIG. 3D, labeling 306 is after dispensing 314. In some embodiments, labeling 306 is after sealing 318. In some embodiments, labeling 306 is prior to conveying 304.

Medication Containers Panel

Figure 4A:
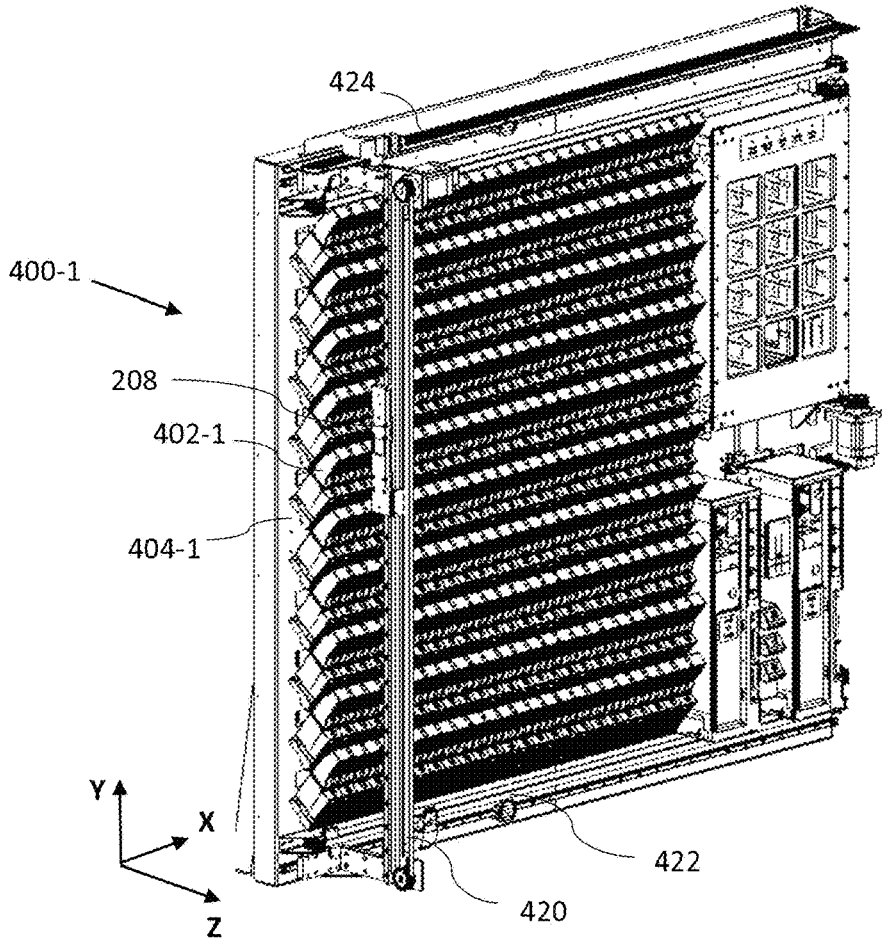
FIG. 4A is a simplified illustration of a perspective view of a medication container panel, according to some embodiments of the invention.
Figure 4B:
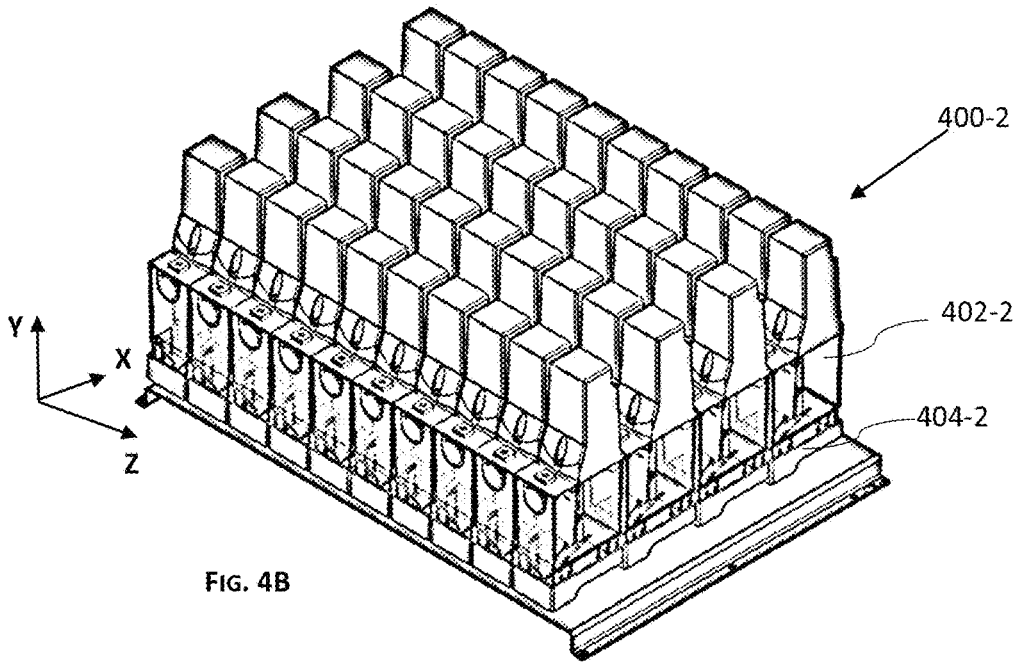
FIG. 4B is a simplified illustration of a perspective view of a medication container panel, according to some embodiments of the invention.

Referring now to FIGS. 4A and 4B, which are simplified illustrations of a perspective view of medication containers panels, according to some embodiments of the invention.

As shown in FIGS. 4A and 4B, according to some embodiments, medication containers panel 400 accommodates a plurality of medication containers 402. In some embodiments, panel 400 has a plurality of docking ports 404 for coupling medication containers 402.

As shown in FIG. 4A, the medication containers 402 are arranged vertically (in direction Y) within a container panel 400-1. In some embodiments, panel 400-1 is vertically flat. In some embodiments, containers 402 are slanted on panel 400-1. In some embodiments, containers 402 are slanted by shaping docking ports 404-1 to couple containers to be in a slanted orientation.

In some embodiments, the panel is slanted. In some embodiments, the panel is arcuate. In some embodiments (not shown), the panel is cylindrical.

A potential advantage of having a medication panel extending vertically is reducing the horizontal size of the panel. In some embodiments, reducing the horizontal size of the panel reduces the horizontal size of the dispensing system.

As shown in FIG. 4B, according to some embodiments, the medication dispensing system has medication container panel 400-2, configured to accommodate a plurality of medication containers 402, arranged horizontally within container panel 400-2. In some embodiments, panel 400-2 is horizontally flat. In some embodiments, panel 400-2 is circular or arcuate about a vertical axis (Y).

A potential advantage of having a medication panel extending horizontally is reducing the vertical size of the panel. In some embodiments, reducing the vertical size of the panel reduces the vertical size of the dispensing system. In some embodiments, disposing the medication containers 402 in a horizontal arrangement reduces the horizontal size of the system.

According to some embodiments, as shown in FIG. 4A, a dispensing head (e.g. 107/208/600) described elsewhere herein is moveable on a vertical rail 420 moveable mounted on medication panel 400, and the dispensing head is configured to move vertically on vertical rail 420. In some embodiments, the dispensing head is configured to move horizontally by moving vertical rail 420 on or more horizontal rails 422/424 provided at panel 400. According to some embodiments (not shown), the dispensing head is moveable on a horizontal rail coupled to the medication panel, and the linear movement of the head is on the horizontal rail. In some embodiments, a vertical movement of the dispensing head is by moving the horizontal rail on or more vertical rails provided at the medication panel.

Dispensing Head with Receptacle Carrier

Figure 5:
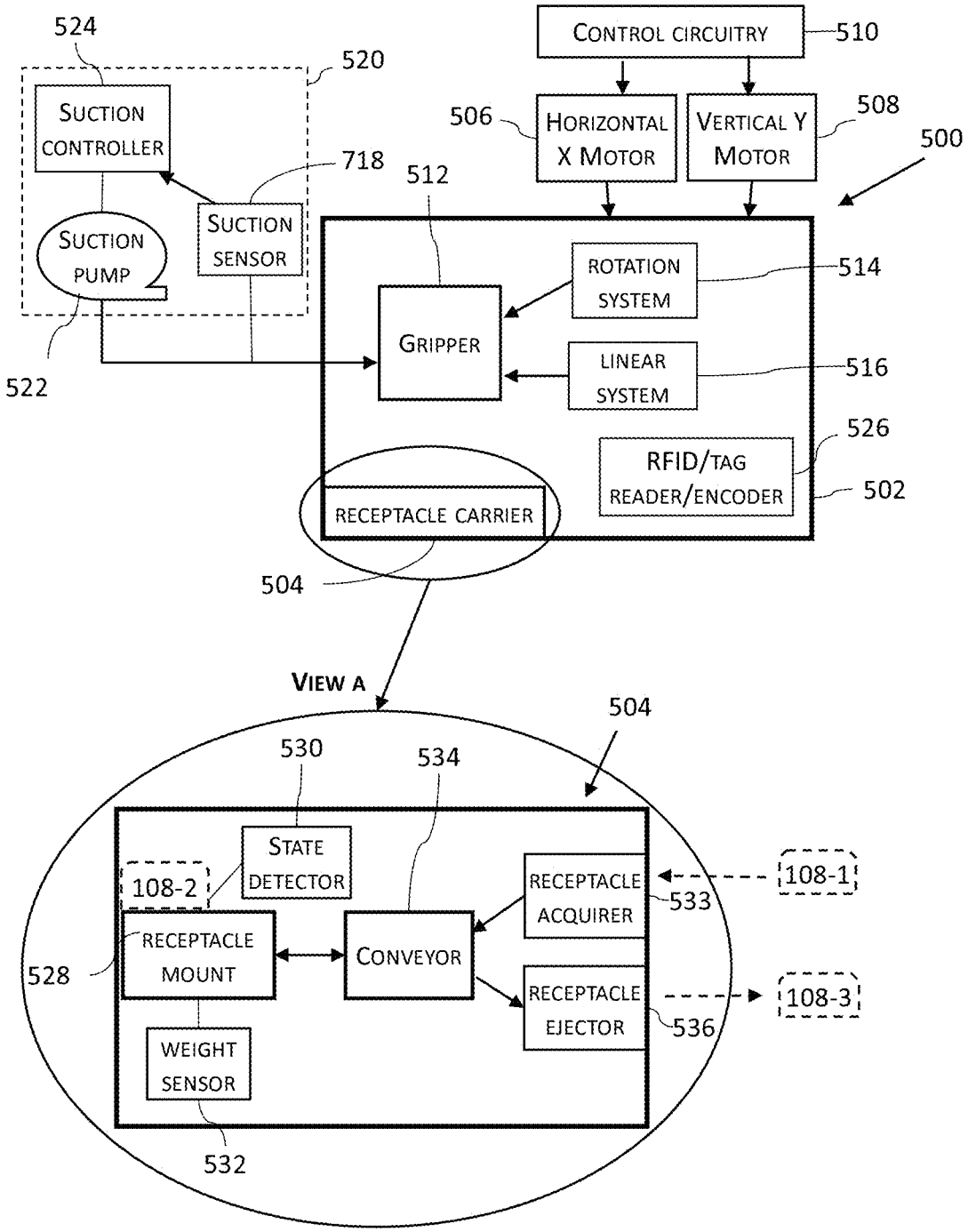
FIG. 5 is a simplified illustration of a block diagram of a dispensing head, according to some embodiments of the invention.

Referring now to FIG. 5, which is a simplified illustration of a block diagram of a dispensing head, according to some embodiments of the invention.

Dispensing head 500 is configured to grab medication from medication containers accommodating medication. According to some embodiments, dispensing head 500 is configured to move in one or more directions to approximate medication containers 402 and receive a medication dosage. According to some embodiments, e.g. when the layout of the medication panel is vertical (e.g. 400-1), approximating a medication container is by moving dispensing head 500 in at least a vertical direction (e.g. direction Y in FIG. 4A). In some embodiments, e.g. when the layout of the medication panel is horizontal (e.g. 400-2), moving dispensing head 500 is at least in a horizontal direction (e.g. directions X and Z in FIG. 4B).

As shown in FIG. 5, dispensing head 500 includes one or more base platforms 502 for holding modules of head 500. According to some embodiments, head 500 includes a gripper 512 for picking medication dosage out of a container. In some embodiments, gripper 512 is a probe gripper, configured to pick a probe which holds medication dosage. In some embodiments, gripper is configured to apply suction in a probe to pick and hold medication by the probe.

According to some embodiments, dispensing head 500 includes a receptacle carrier 504 for coupling one or more medication receptacles such as 108 to head 500.

According to some embodiments, dispensing head 500 is moveable by one or more motors. In some embodiments, motor 506 moves head 500 in horizontal direction X. In some embodiments, motor 508 moves head 500 in vertical direction Y. In some embodiments, one of motors 506 or 508 moves head 500 in horizontal direction Z. In some embodiments, one or more of motors 506/508 are actuated by control circuitry 510. In some embodiments, control circuitry 510 is coupled to dispensing head 500. In some embodiments, for example as shown in FIG. 5, control circuitry 510 is located outside head 500. In some embodiments, motor 506 is coupled to head 500. In some embodiments, for example as shown in FIG. 5, motor 506 is disposed outside head 500 and motor motion is transferred to head 500. In some embodiments, motor 508 is coupled to head 500. In some embodiments, for example as shown in FIG. 5, motor 508 is disposed outside head 500 and motor motion is transferred to head 500. In some embodiments, one or more of motors 506/508 are step motors. In some embodiments, one or more of motors 506/508 are servo motors.

According to some embodiments, the dispensing system includes a suction system 520 connected to head 500, for attaching medication dosage to an extraction probe as described elsewhere herein. In some embodiments, suction is provided by suction system 520 to probe gripper 512 for applying suction through the probe. In some embodiments, suction system 520 includes a suction pump 522. In some embodiments, suction system 520 includes a suction controller 524 connected to suction pump 520 for controlling the suction provided to gripper 512. In some embodiments, suction controller 524 is disposed within head 500. In some embodiments, determining the required suction power is according to the characteristic and parameters of the medication dosage (e.g. type, shape, weight, etc.). In some embodiments, suction system 520 includes a suction sensor for measuring suction power provided to gripper 512. In some embodiments, the suction sensor is connected to gripper 512. In some embodiments suction power is controlled by one or more suction valves coupled to dispensing head 500.

According to some embodiments, control circuitry 510 controls the movement speed of head 500 according to the characteristic and parameters of the medication dosage (e.g. type, shape, weight, etc.). A potential advantage of controlling the speed of head 500 and/or suction power is reducing loosing of a medication dosage coupled to dispensing head 500 after being extracted out of the container. Another potential advantage of controlling the suction power is reducing of failures in extracting medication dosage by the dispensing head 500.

According to some embodiments, gripper 512 is linearly moveable in respect to platform 502. In some embodiments, gripper 512 is configured to grab a probe inserted in a medication container by approximating gripper 512 to the probe for grabbing the probe away of the container by a linear motion. In some embodiments, gripper 512 is configured to return the probe to the container by a linear motion towards of the container. In some embodiments, gripper 512 is actuated to move linearly by a linear system 516 coupled to platform 502. In some embodiments, moving gripper 512 in linear motion is without moving platform 502 in respect to the medications panel.

According to some embodiments, a picked probe is rotated by gripper 512 to be positioned above a medication receptacle for dispensing extracted medication dosage into the medication receptacle. In some embodiments, gripper 512 is rotationally coupled to platform 502. In some embodiments, rotating of gripper 512 is by rotation system 514 coupled to platform 502. In some embodiments, head 500 is configured to move the gripper 512 in a rotational motion without moving platform 502 in respect to the medication panel. In some embodiments, there is no linear movement of gripper 512 in a horizontal direction away of the container between the extracting and the dispensing of medication dosage. In some embodiments, the rotation is in the range of 10 to 85 deg. In some embodiments, the rotation is in the range of 25 to 75 deg. In some embodiments, the rotation is in the range of 30 to 60 deg.

In some embodiments, control circuitry 510 outputs positioning signals to actuators 514/516 to move gripper 512 to position the opening of the receptacle in a horizontal distance of less than 10 cm from the medication dosage. In some embodiments, control circuitry 510 outputs positioning signals between or during outputting approximating signals and outputting dosage manipulation signals.

A potential advantage in limiting the motion of the probe by head 500 is that the time the medication container is left open when probe is out of the container minimized. In some embodiments, the time between grabbing of the probe out of the container by gripper 512 and dispensing the medication dosage in the medication receptacle is shorter than 10 sec. In some embodiments, the time between grabbing of the probe out of the container by gripper 512 and dispensing the medication dosage in the medication receptacle is shorter than 4 sec. In some embodiments, the time between grabbing of the probe out of the container by gripper 512 and dispensing the medication dosage in the medication receptacle is shorter than 1 sec. Another potential advantage is reducing accidental loosing of the medication dosage from the probe prior to dispensing the medication dosage inside the medication receptacle.

According to some embodiments, head 500 is configured to communicate with the medication container via a chip or RFID tag mounted at the container, or by using barcode at the container. In some embodiments, the RFID/chip is used to transmit operational parameters of the container. Some examples of information that can be communicated via RFID/chip are: identifying medication within container, counting medication dosages, receiving status details, dispensing status, etc. In some embodiments, head 500 is updating information encoded on the container. For example: updating medication dosage remaining within container after extracting dosage by head. In some embodiments, head 500 has a RFID/tag reader and/or encoder 524. In some embodiments, read/encoder 526 is coupled to platform 502. In some embodiments, read/encoder 526 is coupled to gripper 512.

According to some embodiments, reader/encoder is movable to enable approximating and detracting to/from the medication container. In some embodiments, read/encoder 526 is configured to move together with gripper 512. For example, for approximating RFID tag/Chip of container, while picking a probe by gripper 512. In some embodiments, reader/encoder 526 is configured to move independently of gripper 512. In some embodiments, reader/encoder 526 is configured to rotate with gripper 512, and to move linearly independently of gripper 512. A potential advantage in moving reader/encoder 526 is that the head 500 is communicating with medication containers, without further moving the head 500. This can help minimizing travel for the head 500 and reducing dispensing process time. A communication of head 500 with container can also help avoiding an initiation of medication extraction in case reader 526 detects some unexpected input from a chip of the container, e.g. out of medication. Such exception can proceed to moving head 500 automatically to another container, without proceeding a faulty dispensing process. This can increase usability, by reducing fault handling by an operator. This can also reduce idling of the dispensing system.

Turning to View A in FIG. 5, which is a simplified block diagram illustration of receptacle carrier 504 according to some embodiments of the present invention.

According to some embodiments, receptacle carrier 504 includes receptacle mount 528, which is configured to hold one or more receptacles (e.g. 108) when dispensing medication dosage into the receptacle.

According to some embodiments, the receptacles are attached to head 500 by coupling the receptacle to a receptacle mount 528. In some embodiment, coupling is by suction power applied to the receptacle by mount 528. In some embodiments, suction system 512 is connected receptacle carrier 504 to provide the suction to mount 528. In some embodiments, suction system 512 connected to carrier 504 is different than suction system connected to gripper 512.

According to some embodiments, carrier 504 includes a state detector 530 for determining if the receptacle held by mount 528 is in an open state or a closed state. In some embodiments, dispensing operation is performed only when state is open. In some embodiments, detector 530 is connected to control circuitry 510 to control dispensing of medication based on receptacle open/closed state. A potential advantage of detecting the open/close state of the receptacle is reducing the risk of missing medication dosage within receptacle. Another potential advantage is reducing waist of medication dosages dispensed into closed receptacles.

According to some embodiments, the weight of the receptacle increases when dispensing medication dosage. In some embodiments, a weight sensor 532 is used for measuring the weight of the receptacle. In some embodiments, suction provided to receptacle mount 528 is determined according to weight measured by sensor 532. In some embodiments, suction controller 516 increases the suction power when weight measurement increases. In some embodiments, measuring of the weight is used to verifying medication dispensing within receptacle.

According to some embodiments, receptacle carrier 504 acquires receptacles from a receptacle supply unit (such as 112). In some embodiments, carrier 504 includes a receptacle acquirer 533, which acquires receptacle from the supply unit. In some embodiments, head 500 is positioned next to engage acquirer 533 with the supply unit.

According to some embodiments, transferring receptacles outside carrier 504 is required one or more time during a dispensing process. In some embodiments, carrier 504 includes a receptacle ejector 536, configured for ejecting receptacle from carrier 504. In some embodiments, receptacles are ejected from head 500 to a medication output/collection unit, such as medication tote (such as 118), after dispensing medication into receptacle.

In some embodiment, acquiring by receptacle acquirer 533 and transferring receptacles outside carrier 504 by ejector 536 is repeated more than once during a single dispensing process. For example: acquiring receptacle from receptacle supply unit (e.g. 112) and then transferring receptacle to a labeling or printing unit (such as 114) and back to head carrier 504. Another example: transferring receptacle to and from sealing/crimping unit (such as 116) prior to disposing receptacle in an output/collection unit, such as medication tote (e.g. 118).

According to some embodiments, receptacle carrier 504 includes a conveyor 534 for transporting receptacles from acquirer 533 to mount 528, e.g. prior to dispensing medication within the receptacle. In some embodiments, transporting receptacles from mount 528 to ejector 536, e.g. after dispensing medication is by conveyor 534. In some embodiments, transporting to ejector 536 is to discard unfilled receptacles, e.g. when an error occurs during the dispensing process.

In some embodiments, dispensing head 500 is configured to hold multiple receptacles by having a plurality of receptacle carriers 504. In some embodiments, dispensing head 500 is configured to hold multiple receptacles by having a plurality of receptacle mounts 528 within receptacle carriers 504.

Figure 6A:
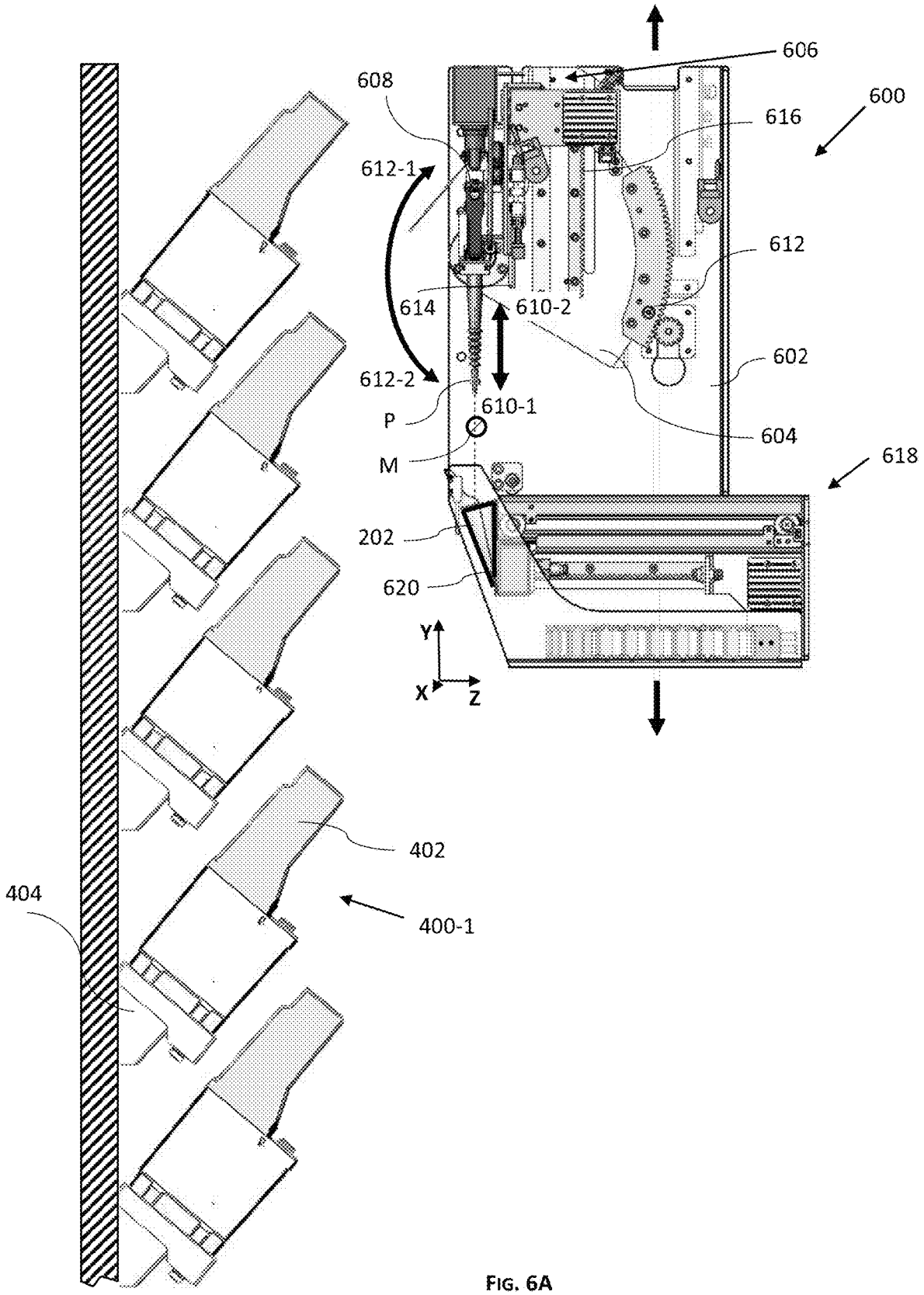
FIGS. 6A-6C are simplified illustrations of a side view of a dispensing system, according to some embodiments of the invention.
Figure 6B:
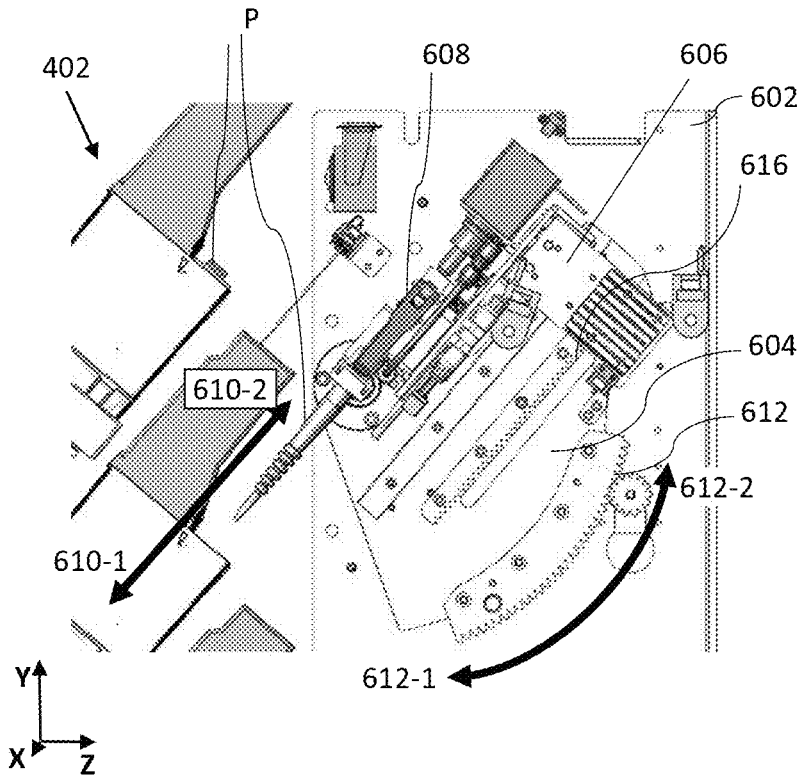
Figure 6C:
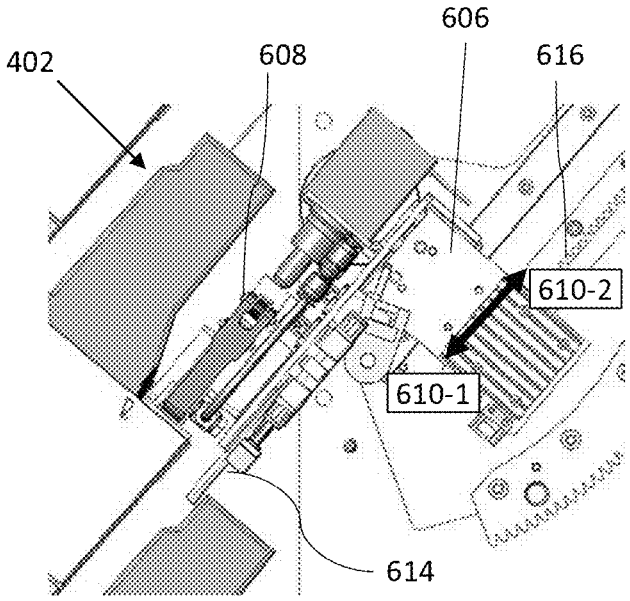

Referring now to FIGS. 6A-6C, which are simplified illustrations of a side view of a dispensing head, according to some embodiments of the invention.

As shown in FIG. 6A, dispensing head 600 is configured to move across a vertical panel 400-1 and approximate containers 402 coupled to panel 400-1. Head 600 is configured to move between containers 402 by a linear movement in a vertical direction Y. In some embodiments, the linear movement is a combination of horizontal movements in direction X and vertical movement in direction Y across panel 400-1.

As shown in FIGS. 6A and 6B, dispensing head 600 includes a head housing 602. In some embodiments, head 600 has a movable platform 604, rotatably coupled to housing 602.

According to some embodiments, head 600 includes a gripper module 606, coupled to platform 604, and a gripper 608 coupled to gripper module 606 and configured for picking a probe P coupled to a medication container 402.

As shown in FIGS. 6A to 6C, in some embodiments, gripper module 606 is linearly moveable in respect to housing 602 in a proximal direction 610-1 and a distal direction 610-2. In some embodiments, gripper module 606 is configured to actuate gripper 608 for grabbing a probe P from the container by approximating gripper 608 to the probe P in a proximal direction 610-1, and grabbing the probe away of the container by a distal linear motion in direction 610-2. In some embodiments, returning of probe P to the container is by actuating gripper 608 by gripper module 606 in a proximal linear motion towards of the container in direction 610-1. In some embodiments, moving gripper 608 in proximal direction 610-1 and distal direction 610-2 is without moving housing 602 in respect to the medications panel (such as 400-1). In some embodiments, proximal direction 610-1 and distal direction 610-2 are vertical in direction Y.

According to some embodiments, rotating gripper 608 in respect to the medications panel is without rotating housing 602 and without moving head 600. In some embodiments, for example as shown in FIGS. 6A and 6B, head 600 includes a gear mechanism 612, interconnecting platform 604 and housing 602. In some embodiments, rotating of platform 604 by gear 612, rotates gripper 608 in directions 612-1 (shown in FIG. 6B) and 612-2 (shown in FIG. 6A). In some embodiments rotational directions 612-1 and 612-2 are about axis X which is perpendicular to axes Y and Z.

According to some embodiments, as described elsewhere herein, head is configured to update information encoded on the container. As shown in FIGS. 6A and 6C, head 600 includes a RFID/tag reader and/or encoder 614, coupled to gripper module 606. In some embodiments, gripper module 606 is configured to actuate reader/encoder 614 in a proximal direction 610-1 and a distal 610-2 direction, to enable approximating and detracting to/from an RFID tag/Chip coupled to a medication container 402.

In some embodiments, reader/encoder 614 is movable in respect to housing 602. In some embodiments, for example as in FIGS. 6A to 6C, reader/encoder 614 is configured to move together with gripper 608, for example, for approximating RFID tag/Chip of container, while picking a probe by gripper 608. In some other embodiments, reader/encoder 614 is configured to move independently of gripper 608.

In some embodiments, head 600 includes a linear gear mechanism 616, interconnecting gear module 606 and housing 602. In some embodiments, moving of gear module 606 by gear 616, moves gripper 608 in directions 610-1 (shown in FIG. 6C) and 610-2 (shown in FIGS. 6A and 6B). In some embodiments, linear gear mechanism 616, interconnects gear module 606 and platform 604. In some embodiments, connecting gear 616 to platforms 604, enables actuating of gripper 608 and/or reader 614 in both linear and rotation motion in respect to housing 602.

According to some embodiments, dispensing head 600 includes envelope carrier 618 for coupling one or more medication envelopes (such as 202) to head 600. In some embodiments, for example as shown in FIG. 6A, envelope carrier 618 is coupled to housing 602, below gripper 608. According to some embodiments, envelope carrier 618 includes envelope mount 620, which is configured to hold an envelope (e.g. 202) when dispensing medication dosage into the envelope. As shown in FIG. 6A, envelope mount 620, is holding envelope 202 vertically under gripper 608. In some embodiments, when a probe P is used to hold the medication dosage, envelope mount 620, is holding envelope 202 vertically under the tip of the probe P, such as a medication disposed at the tip of the probe is dispensed by dropping the medication M from the probe P into the open envelope.

In some embodiment, holding the envelope is by suction power applied to a surface of the envelope by mount 620. In some embodiments, a suction system (such as 520) is connected to envelope carrier 618 to provide suction to a suction port disposed in mount 620.

Dispensing Head Detached of Receptacle Carrier

Figure 7A:
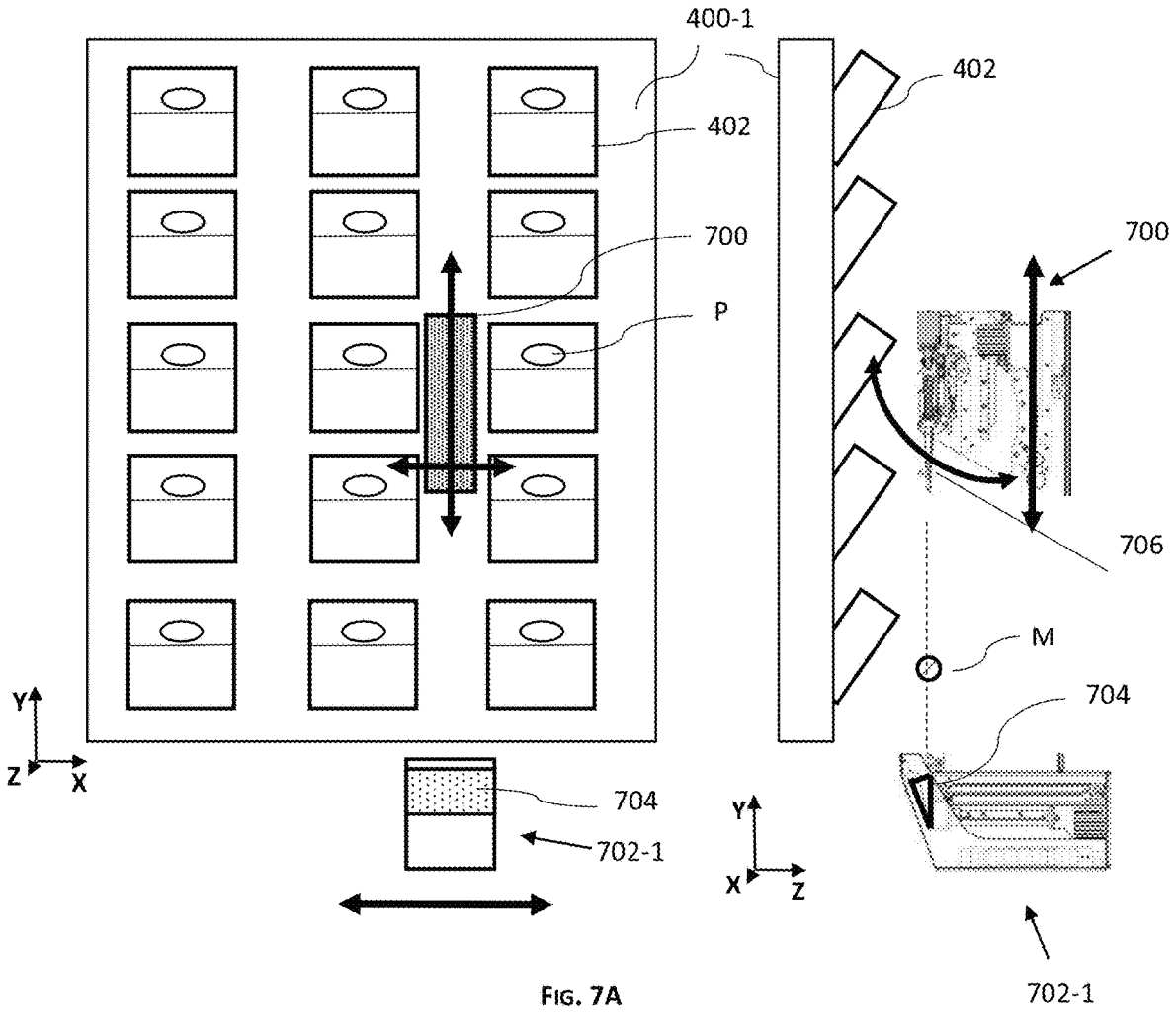
FIG. 7A is a simplified illustration of a side view and a front view of a dispensing system, according to some embodiments of the invention.
Figure 7B:
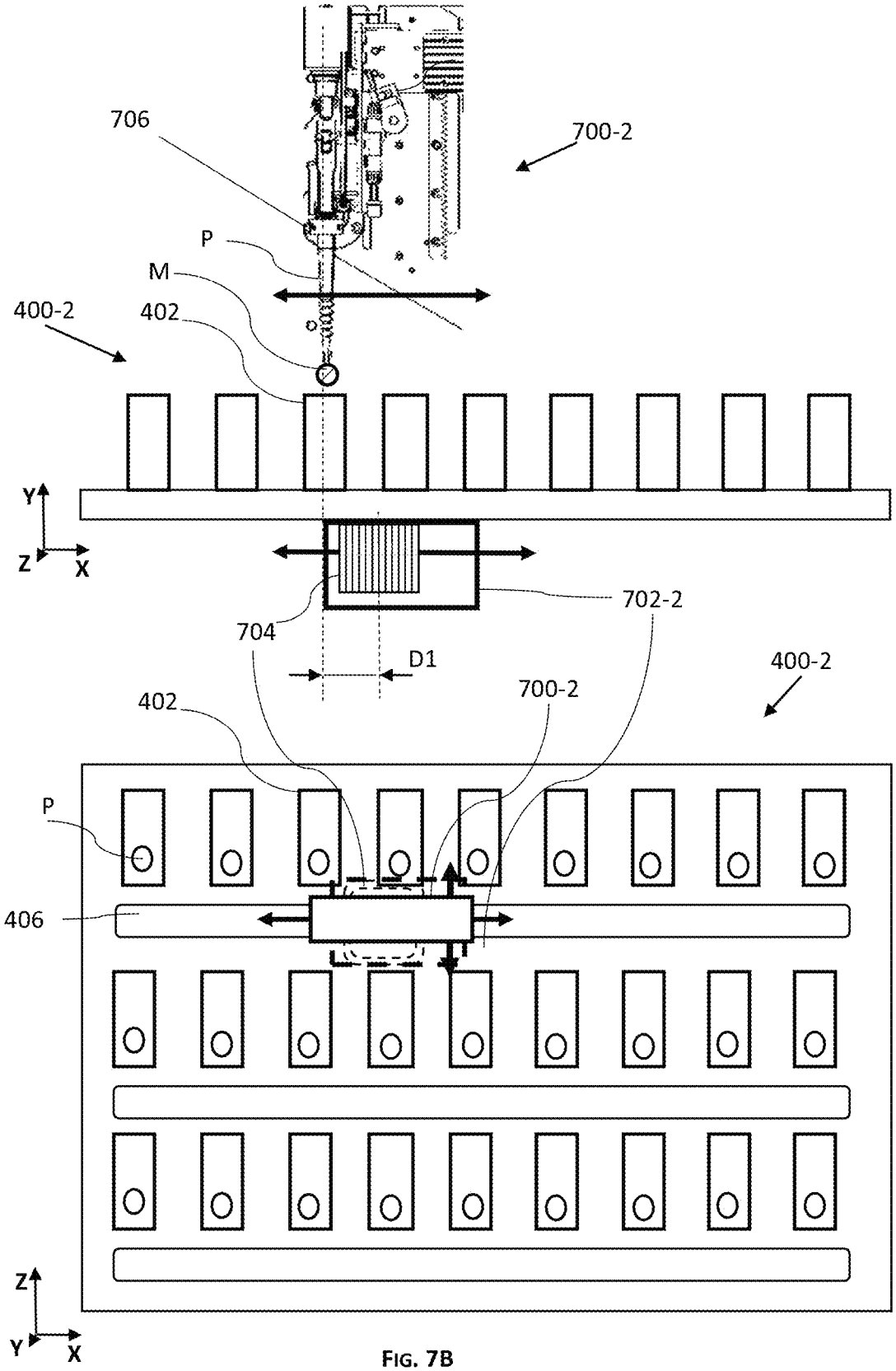
FIG. 7B is a simplified illustration of a side view and a top view of a dispensing system, according to some embodiments of the invention.
Figure 7C:
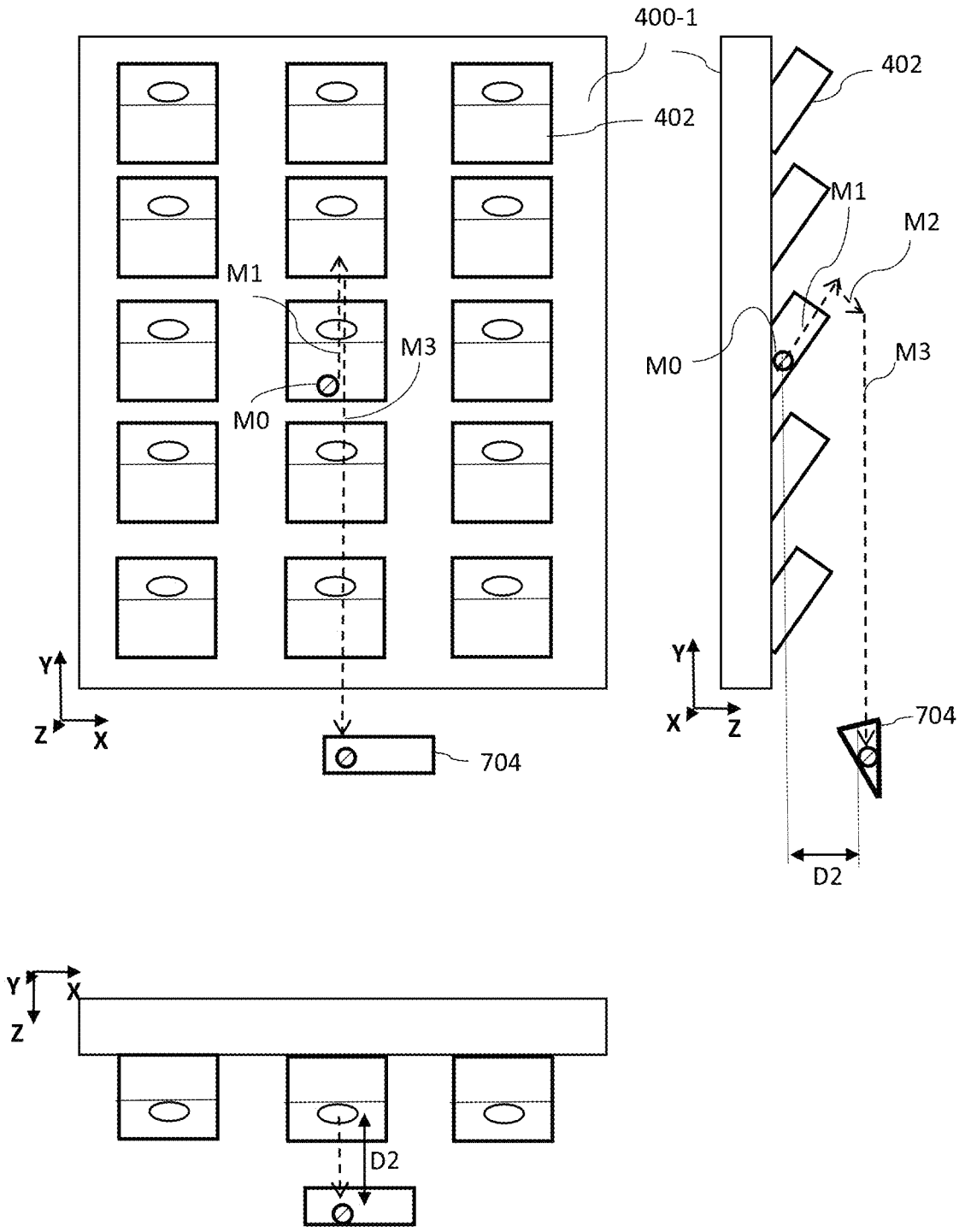
FIG. 7C is a simplified illustration of a side view and a top view of a dispensing system, according to some embodiments of the invention.

Turning to FIGS. 7A to 7C, which are simplified illustrations of side views of dispensing heads and medication container panels, according to some embodiments of the invention.

FIG. 7A shows a size view and a front view of an embodiment of a vertical containers panel 400-1, and FIG. 7B shows a size view and a top view of an embodiment of a horizontal containers panel 400-2. In both embodiments, carrier 702-1/2 is decoupled of dispensing head 700-1/2.

According to some embodiments, one or more carrier actuators move carrier 702-1/2 horizontally. In some embodiments, for example as shown in FIGS. 7A and 7B, carrier 702-1/2 moves receptacle 704 horizontally below medications panel 400-1/2.

In some embodiments, moving horizontally, is to maintain a horizontal distance D1 between head 700 and an opening of receptacle 704 within a pre-define range. In some embodiments, distance D1 is shorter than 50 cm. In some embodiments, distance D1 is shorter than 10 cm. In some embodiments, distance D1 is shorter than 20 cm. In some embodiments, distance D1 is shorter than 5 cm. In some embodiments, receptacle 704 is vertically below dispensing head 700. In some embodiments, for example as shown in FIG. 7B, distance D1 is measured between gripper 706 coupled to dispensing head 700, and an opening of receptacle 704. In some embodiments, for example as shown in FIG. 7B, distance D1 is measured between the location of holding a medication dosage M by gripper 706 and an opening of receptacle 704. In some embodiments, the location of holding a medication dosage M is a tip of probe P (as discussed elsewhere herein).

In some embodiments, for example as shown in FIG. 7B, the distance D1 is controlled by moving both head 700-2 and carrier 702-2 in a horizontal direction (e.g. direction X).

In some embodiments, dispensing system includes a control circuitry having a carrier controller for actuating the carrier 702-1/2. In some embodiments, the control circuitry is actuating carrier 702-1/2 according to an optimization algorithm, which determines the shorter travel of the dispensing head after receiving a medication dosage. In some embodiments, control circuitry controls the speed of moving carrier 702-1/2 according to a speed optimization algorithm. In some embodiments, as described elsewhere herein, speed is controlled to reduce loosing of medication dosage prior to dispensing into receptacle.

According to some embodiments, moving carrier 702-1/2 to position carrier 702-1/2 at a horizontal distance from dispensing head is prior to approximating container 402. In some embodiments, moving carrier 702-1/2 to position carrier 702-1/2 at a pre-defined horizontal distance from dispensing head is after dispensing head 700-1/2 receives a medication dosage and prior to dispensing it into the receptacle 704.

As shown in FIG. 7A, carrier 702-1, is holding envelope receptacle 704 vertically under dispensing head 700, such as a medication is dispensed by head 700 by dropping the medication M into the open receptacle 704. FIG. 7C, illustrates an exemplified path M0-M3 of medication dosage M, from being disposed M1 in container 402, extracted M1out of container 402, positioned M2 away of container 402, and dropped M3 into a funnel defined by the open envelope 704 located vertically underneath medication dosage M after being extracted from container 402.

In some embodiments, for example as shown in FIG. 7B, horizontal panel 400-2 includes slots 406, which allow to dispense a medication dosage M from head 700-2 located at one side of panel 400-2 (e.g. top of panel) to receptacle 704, located at an opposite side of panel 400-2 e.g. bottom of panel).

According to some embodiments, carrier 702-1/2 is independent of head 700 and is configured to be attached to head 700 prior to dispensing medication. In some embodiments, a vertical carrier actuator, moves carrier 702 vertically to couple carrier 702 to dispensing head 700 during the dispensing process (as described elsewhere herein).

Receptacles Envelopes

As described elsewhere herein, receptacles are in some embodiments of the invention in the form of medications envelopes.

Figure 8A:
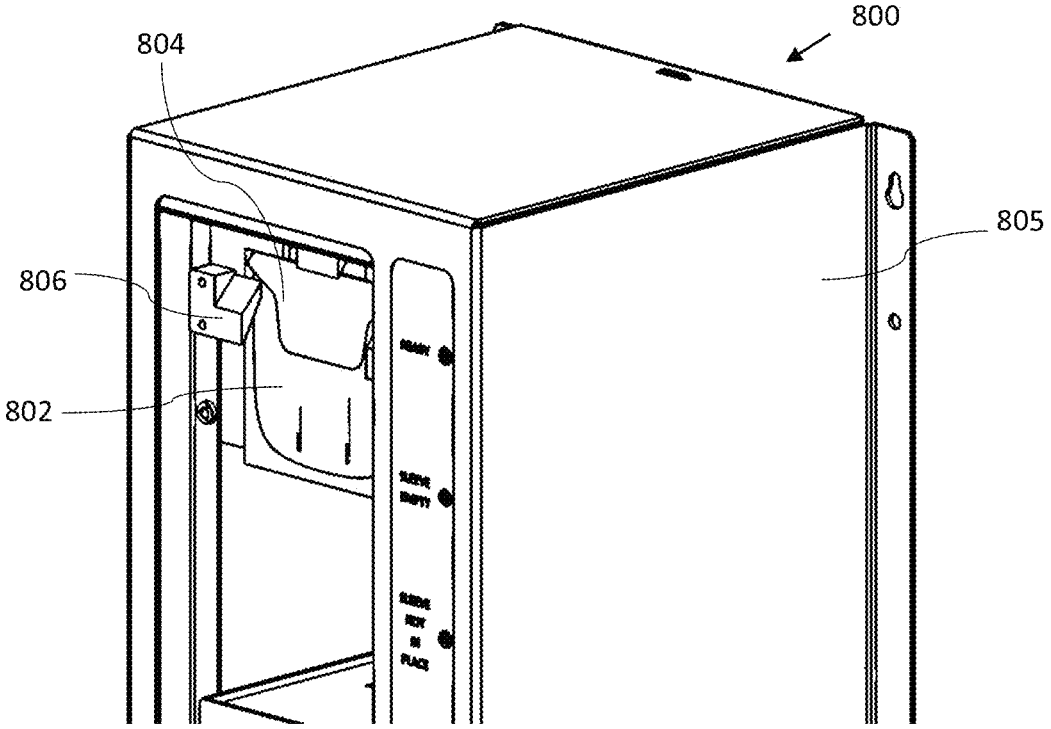
FIGS. 8A and 8B are simplified illustrations of a perspective view of an envelope supply unit, according to some embodiments of the invention.
Figure 8B:
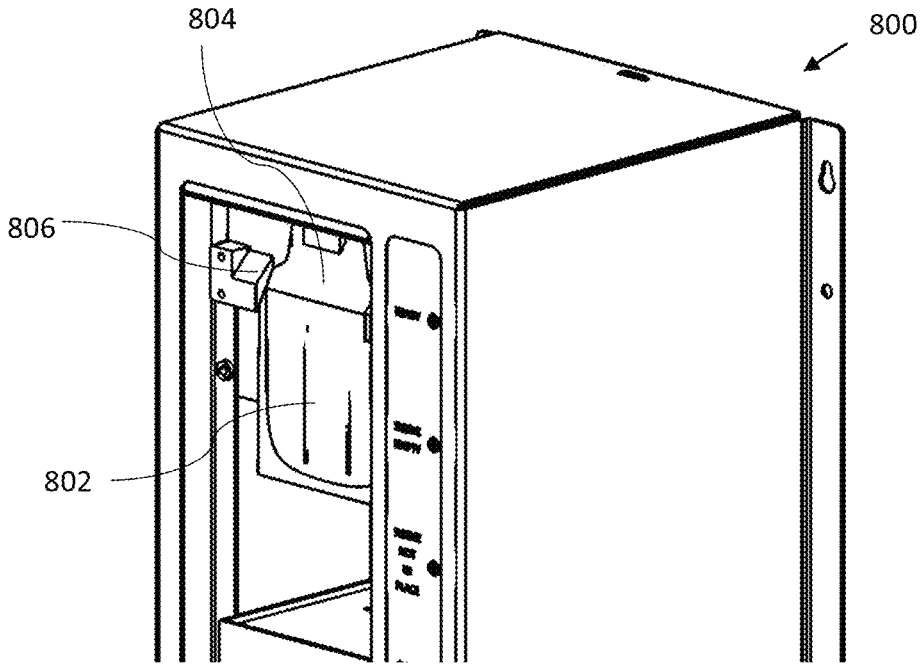

Referring now to FIGS. 8A to 8B, which are simplified illustration of a perspective view of an envelope supply unit, according to some embodiments of the invention.

According to some embodiments, envelope supply unit 800 is configured to provide receptacles in the form of medication envelopes 802. According to some embodiments, envelope 802 has a foldable flap 804. As shown in FIG. 8A, flap 804 has a folded state, in which flap 804 is folded over the main body of envelope 802. In some embodiments, envelope 802 is stored in supply unit 800 in a folded state. In some embodiments, the folded state is a state in which envelope 802 is at its most compact size. As shown in FIG. 8B, flap 804 has an unfolded state, in which flap 804 is unfolded and is positioned away of the main body of envelope 802. In some embodiments, the unfolded state is the state in which envelope 802 is shaped prior to transitioning envelope 802 to the receptacle carrier.

According to some embodiments, supply unit 800 has a supply unit housing 805 in which one or more envelopes 802 are stored. In some embodiments, unit 800 has one or more flap openers 806 coupled to housing 805 to open flap 804. In to some embodiments, supply unit 800 is turning flap 804 of envelope 802 from a folded state to an unfolder state by moving envelope 802 downward, and pushing flap 804 by openers 806. In some embodiments, feeding envelope 802 to an envelope carrier is by moving envelope 802 downwards and outside housing 805. In some embodiments, feeding an envelope carrier is after coupling supply unit 800 to the carrier.

Figure 9A:
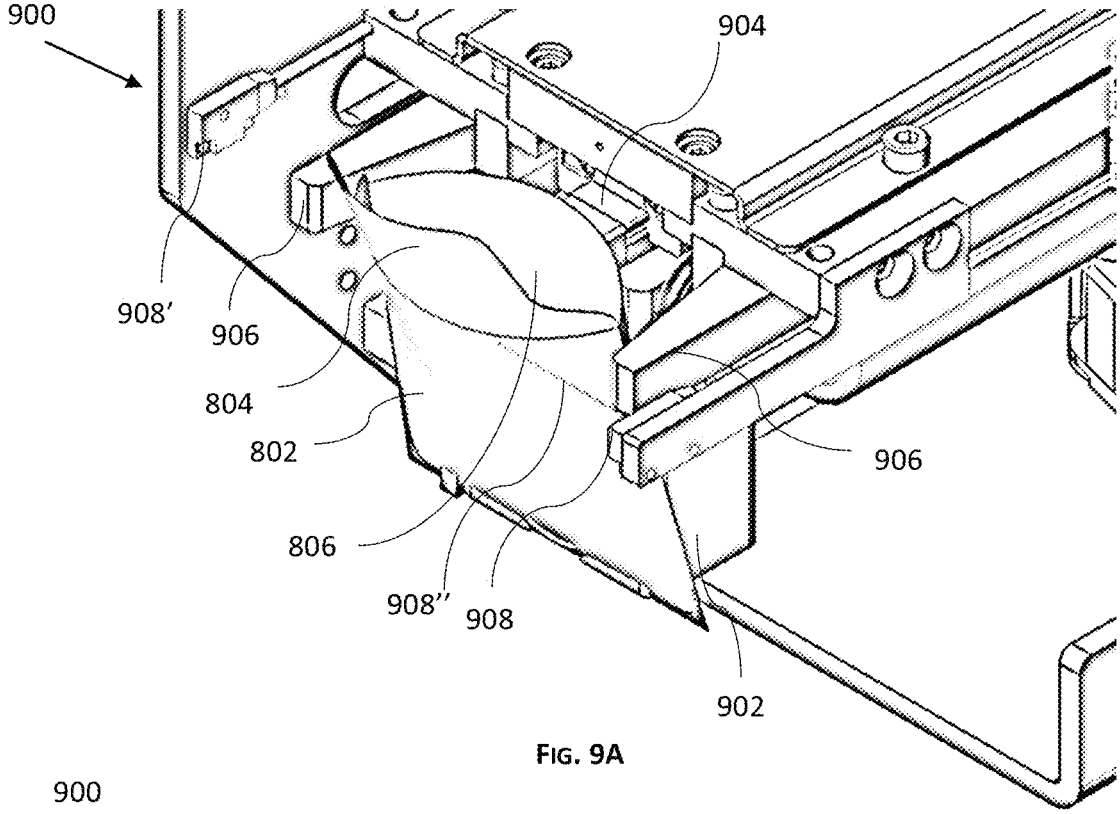
FIGS. 9A and 9B are simplified illustrations of a perspective view and a top view of a portion of an envelope carrier, according to some embodiments of the invention.
Figure 9B:
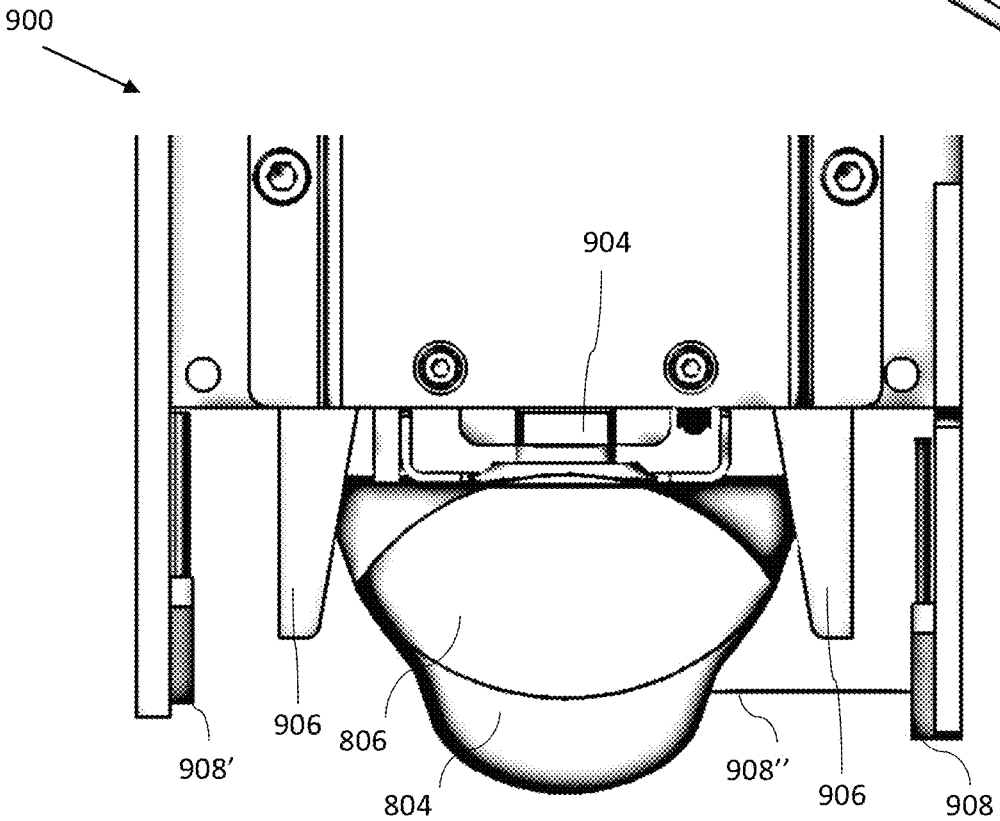

Referring now to FIGS. 9A and 9B, which are simplified illustrations of a perspective view (9A) and a top view (9B) of a portion of an envelope carrier on which a medication envelope is mounted during the dispensing process, according to some embodiments of the invention.

Envelope carrier 900 can be one of the receptacle carriers described elsewhere herein (e.g. 618, 504). As shown in FIGS. 9A and 9B, envelope carrier 900 includes an envelope mount 902, configured to hold envelope 802. In some embodiments, mount 902 comprises one or more suction cups to couple envelope 802 to carrier 900 by applying suction on a face of envelope 802. According to some embodiments, carrier 900 is configured to hold envelope 802 in an open state in which opening 806 is formed at its upper portion for receiving a medication dosage.

According to some embodiments, carrier includes retracting module 904 that retracts an upper portion of envelope 802 to form opening 806. In some embodiments, retracting module 904 detracts an upper portion of envelope 802 to close opening 806. In some embodiments, retracting module 904 is telescopic.

According to some embodiments, carrier 900 includes two forks 906 that hold envelope 802 in an open state. In some embodiments, forks 906 hold envelope 802, while retracting module 904 retracts its upper portion. In some embodiments, forks 906 are movable to change the distance between them. In some embodiments, forks 906 clamp envelope 802 and reduce the distance between each other to open envelope 802. In some embodiments, closing envelope 802 is by increasing the distance between forks 904. In some embodiments, forks 906 are coupled to mount 902. According to some embodiments, carrier 900 has an envelope sensor 908 to check if envelope 802 is in open state. In some embodiments, sensor 908 is configured to check the state of envelope 802 by transmitting an optical beam 908" between a transmitter 908 and a receiver 908'. In some embodiments, opening/closing of envelope 802 is initiated in accordance to signals of sensor 908.

In some embodiments, carrier 900 has a flap sensor that checks if flap 804 is unfolded. In some embodiments, flap sensor is configured to check the state of flap 804 by sensing an interruption of an optical beam transmitted between a transmitter and receiver, in an unfolded state.

Referring now to FIGS. 9C to 9F, which are simplified illustrations of perspective views (9C and 9E), a side view (9D), and a top view (9F) of a portion of an envelope carrier on which a medication envelope is mounted during the dispensing process, according to some embodiments of the invention.

Figure 9C:
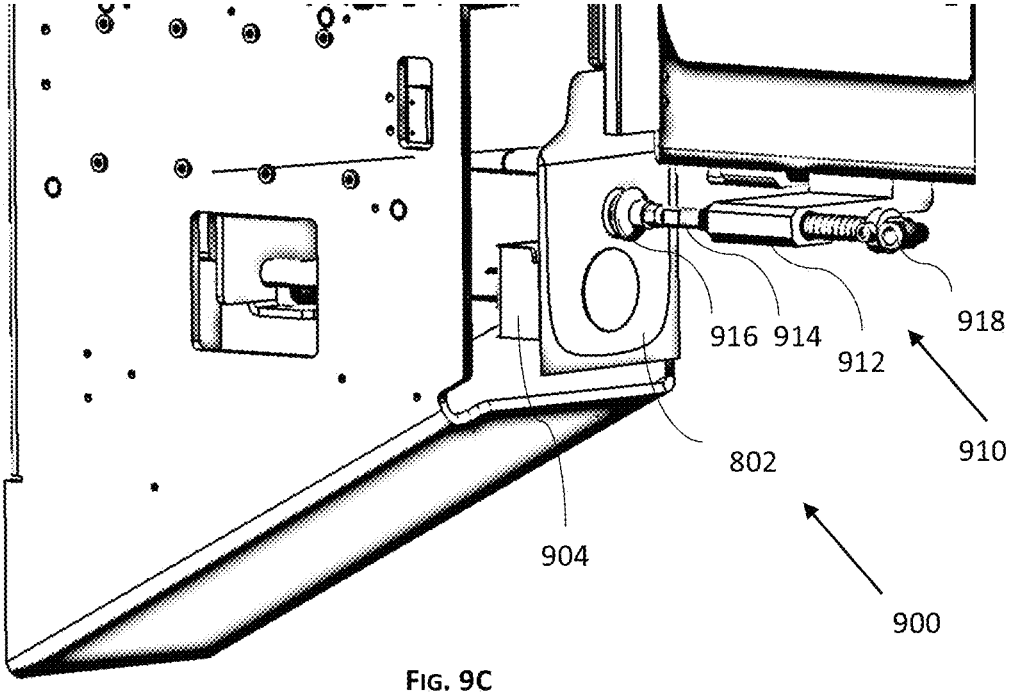
FIGS. 9C and 9E are simplified illustrations of perspective views of a portion of an envelope carrier, according to some embodiments of the invention.
Figure 9D:
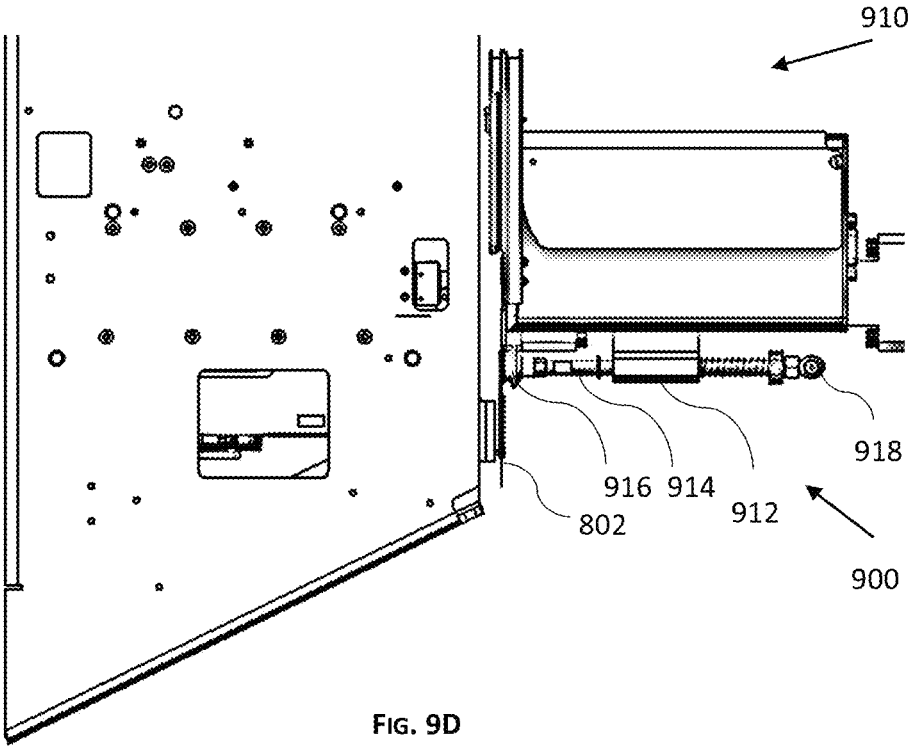
FIG. 9D is a simplified illustration of a side view of a portion of an envelope carrier, according to some embodiments of the invention.
Figure 9E:
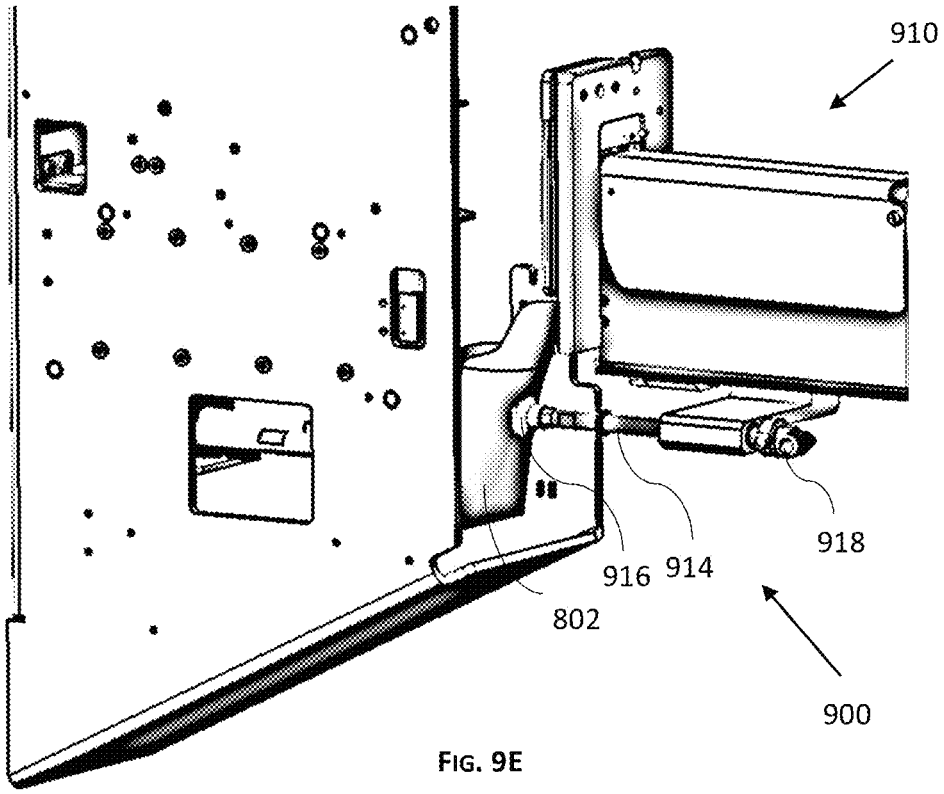
Figure 9F:
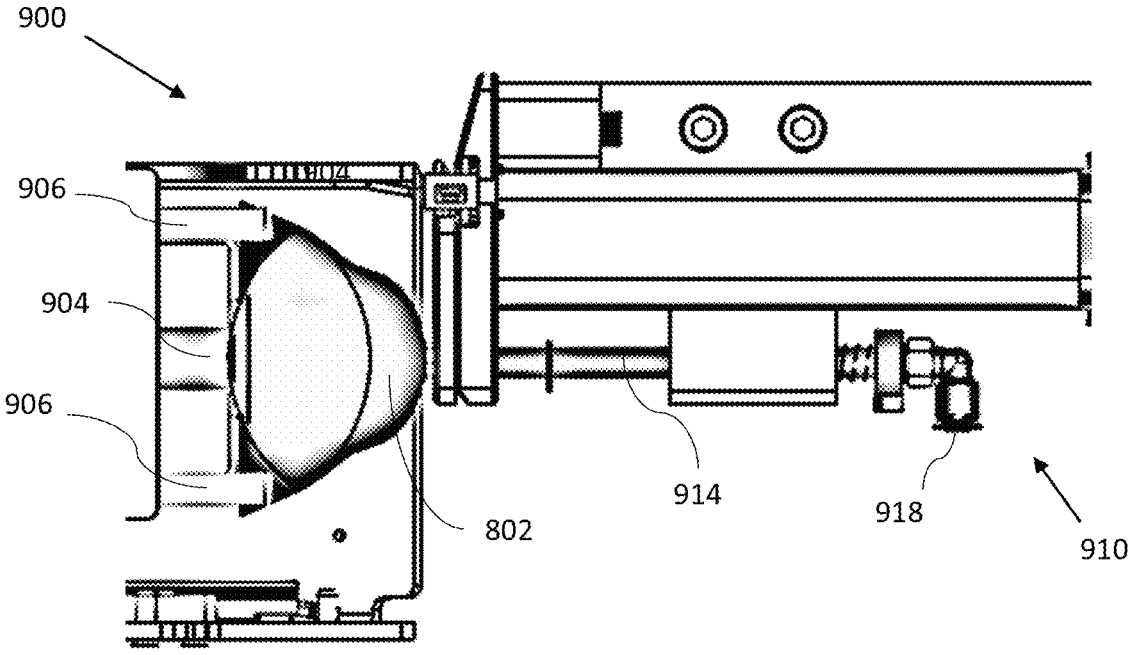
FIG. 9F is a simplified illustration of a top view of a portion of an envelope carrier, according to some embodiments of the invention.

As shown in FIGS. 9C to 9F, an example embodiment of envelope carrier 900 comprises an envelope opener module 910 to modify the state of the envelope between a closed state (as shown in FIGS. 9C-9D) and an open state (as shown in FIGS. 9E-9F).

Envelope opener module 910, comprises a bracket 912, a manipulator 914 movably coupled to bracket 912 and having a proximal pulling head 916 and a distal end 918.

In the example embodiment of FIGS. 9C to 9F modifying the state of envelope 802 between closed state and open state is by engaging pulling head 916 with one face of envelope 802 and retracting module 904 with an opposite face. In some embodiments, opening is by coupling pulling head 916 and retracting module 904 to two opposite faces of envelope 802 and actuating one or more of pulling head 916 and retracting module 904 to move away from each other. Closing envelope 802 is by approximating pulling head 916 and retracting module 904. In some embodiments, control circuitry initiates the moving of one or more of pulling head 916 and retracting module 904.

According to some embodiments, coupling pulling head 916 with a face of envelope 802 is by suction. In some embodiments, suction is applied via distal end 918 through manipulator 914. In some embodiments, coupling is by anchoring pulling head 916 to envelope 802. In some embodiments, coupling is by applying a sticky material at pulling head 916. In some embodiments, coupling is by applying an electrostatic force at pulling head 916.

In some embodiments, manipulator 914 moves linearly towards and away of envelope 802 by a screwing within bracket 912. In some embodiments, manipulator 914 is telescopic.

According to some embodiments, opener module 910 is coupled to envelope supply unit 800. In some embodiments, opener module 910 and envelope supply unit 800 form a single unit. In some embodiments, carrier 900, opener module 910, and envelope supply unit 800 form a single unit. In some embodiments, dispensing head (as described elsewhere herein), carrier 900, opener module 910, and envelope supply unit 800 form a single unit.

Other Exemplified Workflows of Dispensing Medication

Figure 10A:
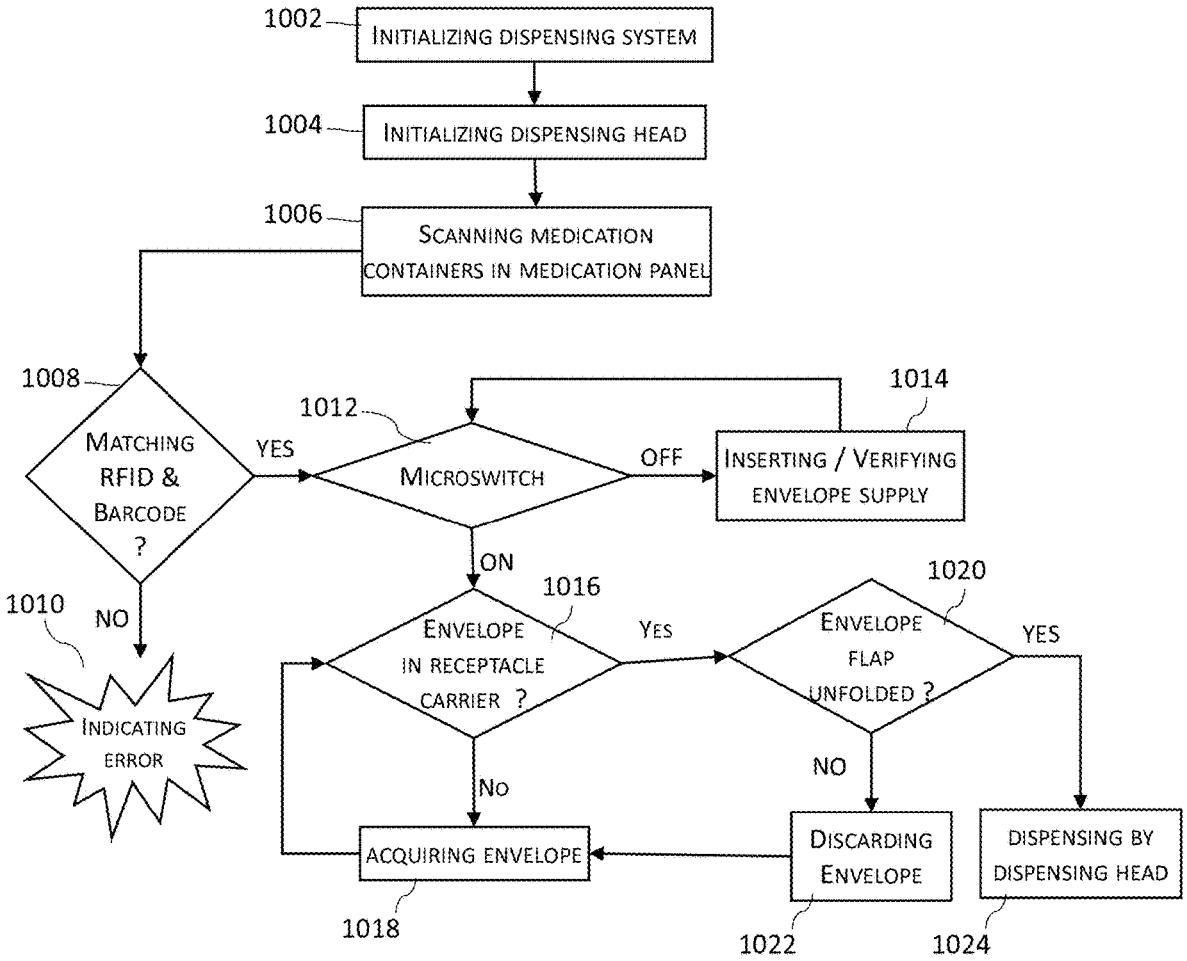
FIGS. 10A and 10B are simplified flow charts, illustrating exemplified workflows of operating a pharmaceutical dispensing system, according to some embodiments of the invention.
Figure 10B:
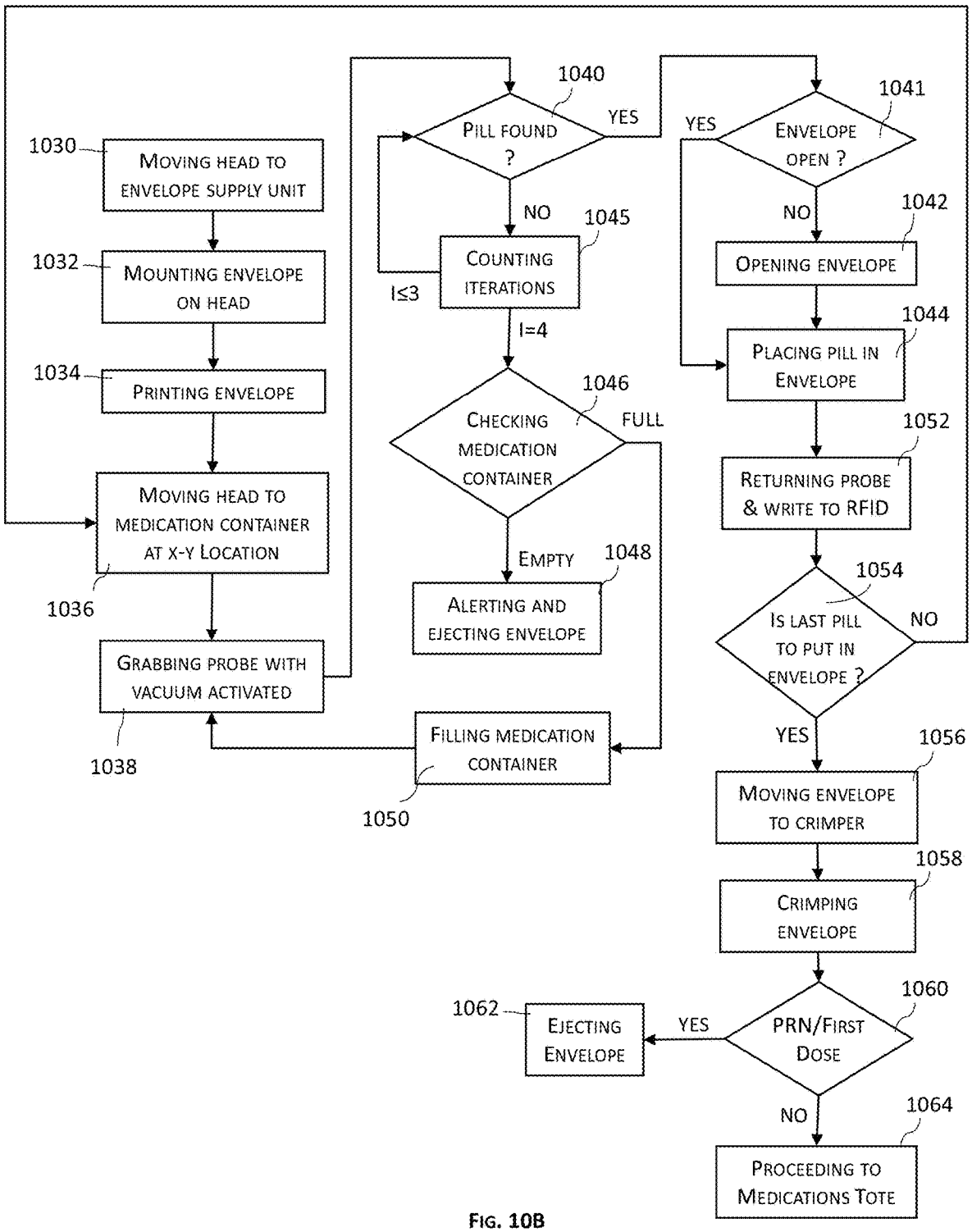

Referring now to FIGS. 10A and 10B, which are simplified flow charts illustrating some of the activities related to operating a pharmaceutical dispensing system (such as 100), according to some embodiments of the invention.

As shown in FIG. 10A, the activities, according to some embodiments include:

1002 Initializing the dispensing system.

In some embodiments, initializing 1002 comprises: preparing supply of medication. In some embodiments, initializing 1002 includes feeding system with prescriptions. In some embodiments, initializing 1002 includes Preparing supply of medication receptacle/envelopes. In some embodiments, initializing 1002 is for sensors, valves, etc. within the dispensing system. In some embodiments, initializing 1002 includes feeding control circuitry with movement plan. In some embodiments, initializing 1002 includes feeding control circuitry with time tables.

1004 Initializing the dispensing head.

1006 Scanning medication containers in medication panel.

Scanning can be for example for: evaluating correct supply of medication in containers, evaluating amount of medication available in medication panel, etc. In some embodiments, scanning is optional, and indication is provided by the dispensing system as described elsewhere herein.

In some embodiments, scanning is by the dispensing head. In some embodiments, scanning is by an operator.

1008 Checking if RFID and/or barcode located at containers match values stored in a database.

1010 Providing an indication about an error, if there is no match.

In some embodiments, correcting an error is by an operator/nurse. In some embodiments, correcting the error is by replacing a container. In some embodiments, replacing a container is done by accessing the medication container, and/or a cartridge attached to the medication container, from the medication panel. In some embodiment access to the container and/or cartridge does not require moving other containers. In some embodiment access to the container and/or cartridge does not require moving other containers using medications drawer.

1012 checking if envelope supply is ready. In some embodiments, checking is by receiving a signal from a microswitch connected to an envelope storage box. In some embodiments, the signal is from sensors, such as: proximity sensor, pressure sensor, and weight sensor.

1014 (optionally) if received an indication about envelopes not ready, verifying and/or inserting envelope supply in dispensing system.

1016 (optionally) checking if envelope is in envelope carrier.

In some embodiments, this step is required when there is a need for acquiring another envelope, for example when there is an additional medication order in queue.

1018 acquiring an envelope from envelope supply unit if checking 1016 indicates that there is no envelope in carrier.

1020 (optionally) checking if envelope flap is unfolded.

According to some embodiments, the flap of the envelope is required to be unfolded in order to expand be body of the envelope for inserting medication within the envelope. In some embodiments, the flap of the envelope is required to be unfolded in order to print on the envelope.

According to some embodiments, checking for unfolded flap 1020 is by one or more sensors. In some embodiments, sensor is disposed at the dispensing head. In some embodiments, sensor is disposed at the envelope carrier. In some embodiments, checking 1020 if flap is unfolded is by a sensor sensing interruptions is light path. In some embodiments, checking 1020 if flap is unfolded is by pressure sensor receiving a pressure of the flap. In some embodiments, checking 1020 if flap is unfolded is by proximity sensor.

1022 discarding envelope if checking 1020 revels the envelope flap is folded. In some embodiments, discarding 1022 is by the dispensing head, which discards the envelope to a discarding zone within the dispensing system. In some embodiments, discharging 1022 is to a discharging zone outside the dispensing system.

1024 Dispensing medication into the envelope.

As shown in FIG. 10B, according to some embodiments dispensing 1024 includes:

1030 Moving head to envelope supply unit.

According to some embodiments, envelope carrier is coupled to the dispensing head and moving 1030 includes moving of the envelope carrier.

1032 Mounting envelope on head.

In some embodiments, moving 1030 and mounting 1032 are prior to checking 1016 if envelope is in envelope carrier. In some embodiments, moving 1030 and mounting 1032 are prior to checking 1020 (in FIG. 10A) if envelope flap is unfolded.

1034 printing data on envelope.

In some embodiments, printing is on envelope having the flap in an unfolded state.

1036 Moving dispensing head to proximate a medication container having medication required to be dispensed.

In some embodiments, moving 1036 includes outputting approximating signals by control circuitry to one or more actuators that move the dispending head to approximate the medication container.

1038 Grabbing probe from medication container. In some embodiments, grabbing is by a probe gripping module coupled to the dispensing head. In some embodiments, a vacuum is activated by the dispensing head and applied on/via the probe.

In some embodiments, grabbing 1038 includes outputting manipulation signals by control circuitry to one or more actuators that move the dispending head or the gripping module.

1040 checking if a pill is found/extracted by probe.

In some embodiments, a sensor disposed at the gripping module to check extracted pill. In some embodiments, checking is by measuring the value of the vacuum at the probe. In some embodiments, vacuum pressure value increases when a pill is disposed at the probe.

1041 checking if envelope is open.

In some embodiments, checking 1041 is by a sensor configured to measure the shape of the envelope to determine if it is open or flat.

1042 opening envelope so it is ready for dispensing.

According to some embodiments, the envelope is in a flat (closed) state until opening 1042 by the dispensing system. In some embodiments, opening 1042 the envelope is by applying suction at a side of the envelope. In some embodiments, opening 1042 the envelope is by blowing air into the envelope by an air nozzle. In some embodiments, opening 1042 is by pressing two sides of the envelope.

Checking 1041 if envelope is open prior to extracting medication can potentially save loosing medication, by preventing dropping medication into a closed envelope. By checking 1041, dispensing head is not actuated to dispense medication prior to having an envelope ready.

In some embodiments, the envelope is open after mounting 1032, and steps 1041-1042 are optional. In some embodiments, opening 1042 is prior to mounting 1032. In some embodiments, checking 1041 is prior to grabbing 1038 and potentially reduce loosing of medication, since medication is not extracted prior to having an envelope ready for dispensing. In some embodiments, checking 1041 is prior to moving 1036 and potentially reduce travel of the head towards medication, prior to having an open envelope.

1044 placing pill in envelope.

In some embodiments, placing pill 1044 is by dropping the pill into envelope disposed under the pill after grabbing 1038. In some embodiments, placing pill 1044 is by terminating a suction that holds the pill on a probe.

1045 optionally repeat checking 1040 if pill is not found on probe. In some embodiments, repeating is for 2-10 times. In some embodiments, repeating is for 3-8 times. In some embodiments, repeating is for 4-6 times.

1046 optionally checking of container has pills. In some embodiments, checking 1046 include counting the number of pills.

In some embodiments, when container is empty of pills, the dispensing system is configured to proceed to alerting and ejecting envelope 1048. In some embodiments, when container is empty, the dispensing system is configured to locate an alternate location having the medication.

In some embodiments, alert is sent to another system in communication with the dispensing system. In some embodiments, an action depends on a response to the alert. In some embodiments, ejecting is by/to a user, which receives details about the alert. In some embodiments, envelope is marked to identify exception.

1050 Filling container with medication.

According to some embodiments, the medication panel have redundancy of medications prepared in more than one medication assemblies. In some embodiments, redundancy reduced dispensing failures by moving the head, having an envelope, to another container without a critical alert, discarding the envelope, interruption, system idling, and/or requiring operator attention.

In some embodiments, after filling 1050, the dispensing head proceed to repeat dispensing steps, by 1038 Grabbing probe from medication container. In some embodiments, there is an optional step of closing envelope prior to repeating dispensing steps. In some embodiments, the envelope is closed between 80-98% of the time between moving 1030 and crimping 1058. In some embodiments, the envelope is closed between 85-95% of the time between moving 1030 and crimping 1058. In some embodiments, the envelope is closed between 90-93% of the time between moving 1030 and crimping 1058. In some embodiments, envelope is open only between checking 1040 and placing pill 1044. Closing the envelope between operations can potentially reduce contamination of medication disposed inside the envelope.

According to some embodiments, described elsewhere herein, the content of the containers assemblies is known prior to having the dispensing head approximating a container.

1052 Returning probe and write to RFID.

1054 Checking if dispensed pill is the last pill required to be dispensed in envelope.

If envelope should receive additional pills, the head will proceed to repeat from step 1036.

If dispensed the last pill required to be placed in envelope, the envelope can be moved 1056 to a crimping module and crimping 1058.

1060 Checking PRN.

1062 Ejecting envelope when checking PRN 1060 is positive.

According to some embodiments, checking PRN 1060 is positive when medication is required to be submit to the patient immediately (e.g. when patient is in pain or not yet in database or just enrolled in facility). In some embodiments, ejecting 1062 is to a nurse in a single manner and not through the medications tote.

1064 Proceeding to position envelope in medication tote. In some embodiments, proceeding 1064 is on scheduled medication runs, so than checking PRN 1060 is negative.

One or more of the checking steps, mention above can be optional. The checking steps can potentially save redundant movements of the dispensing head, for example, when medication is not ready in container or envelope is not in a proper state, save extraction of medication when envelope is not ready, and save movement of head having a medication when envelope is not open.

Extraction Probe

According to some embodiments, a detachable probe P is coupled to the medication containers (such as 402) for picking medication dosage. In some embodiments, extracting medication dosage is by grabbing probe P out of the medication container by the dispensing gripper (such as 106608 described elsewhere herein).

According to some embodiments, the dispensing system has a control circuitry (such as 109) that outputs manipulation signals to actuate the dispensing head to manipulate probe P. In some embodiments, the signals include velocity profile. In some embodiments, signals include acceleration profile. In some embodiments, signals include the length and the direction of movements. In some embodiments, the manipulation signals and/or the positioning signals are selected according to one or more parameters of the medication dosage. In some embodiment the control circuitry is coupled to the dispensing head.

In some embodiments, probe P has a tip configured to be disposed within the medication container, so that probe P can access medication disposed with the container. According to some embodiments, picking medication dosage is by applying suction through the tip of probe P. In some embodiments, suction is applied by the dispensing head and probe P is hollow to transfer suction to its tip. According to some embodiments, releasing the medication dosage of probe P is by terminating the suction.

In some embodiments, probe P is configured to pick medication by a grasping element disposed at the tip of the probe P. In some embodiments, grasping by probe P is without suction.

Lost Medication Collector

Medication dosages may be lost/fall during a dispensing operation or due to other circumstances. According some embodiments, dispensing system 100 can be configured to for tracking and colleting medication dosage that failed to be disposed into receptacles 108.

Turning back to FIG. 1, dispensing system 100 includes a lost medication collector 120 in which medication dosages, such as pills, can accumulate. In some embodiments, collector 120 is disposed at a bottom portion of panel 102. In some embodiments, collector 120 is disposed below panel 102 (outside the panel). In some embodiments, collector 120 is removable. In some embodiments, collector 120 is in the form of a drawer. In some embodiments, collector 120 collects and conveys lost medication out dispensing system 100 automatically. In some embodiments, dispensing system 100 provides indications to the operator about one or more lost medication dosages.

A potential advantage of having a collector 120 is an increased usability of the dispensing system. Another potential advantage of having a collector 120 is increasing liability of the pharmacy by reducing the number of lost drugs and providing tracking records of the medications. Another potential advantage of having a collector 120 is reducing system downtime that could be required to release lost medication dosages. In some embodiments, dispensing system 100 includes an internal camera 122.

In some embodiments, camera 122 can be used to locate medication dosage that failed to be disposed into receptacle 108. In some embodiments, camera 122 is coupled to dispensing head 107.

Returning Receptacles/Envelopes

According to some embodiments, dispensing system 100 supports the process of returning receptacles/envelopes having medications. In some embodiments, closed receptacles/envelopes can be returned by storing returned receptacles/envelopes in a storage. In some embodiments, storage is configured to maintain the quality of the returned medication. In some embodiments, returning receptacles/envelopes includes scanning of the receptacles/envelopes by a scanner 128 connected or in communication with medication databases.

Preparation Steps

According to some embodiments, the dispensing process shown in FIGS. 3A to 3D, includes some preparation activities performed by facility personnel, such as: system technician, nurse, and pharmacist. In some embodiments, the dispensing process is followed by activities on packaged medications performed by the facility personnel.

According to some embodiments, the preparations steps include feeding dispensing system (e.g. 100) with prescription data. The prescription data can be of the patients in the healthcare facility.

According to some embodiments, the preparations steps include preparing a supply of medication receptacles (such as 108).

According to some embodiments, the preparations steps include preparing the medication containers (such as 104). In some embodiments, the medication containers comprise a cartridge by which medication is disposed within the container. In some embodiments, preparing is in accordance to data received about planned medication dosages. In some embodiments, the data is about medication types within prescription data. In some embodiments, preparing is in accordance to operational procedures unrelated to feeding of prescriptions.

According to some embodiments, the arrangement of medication containers 104 at panel 102 is optimized to reduce the travel trajectory of dispensing gripper 106. In some embodiments, optimizing the arrangement is in accordance to historical data of the movements of dispensing gripper 106 and/or medication dispensed by system 100, and/or a dispensing plan. In some embodiments, the location of medication containers 104 is determined by data about medication usage. In some embodiments, data is created by a computer 130 connected to the dispensing system 100. In some embodiments, data includes at least one of: prescribed medications, dispensed medication, medication extracted from medication containers 104.

General

It is expected that during the life of a patent maturing from this application many relevant medication types, medication containers, medication receptacles, and probes, will be developed and the scope of the terms medication types, medication containers, medication receptacles, and probes are intended to include all such new technologies a priori.

The terms "comprises", "comprising", "includes", "including", "having" and their conjugates mean "including but not limited to". The term "consisting of" means "including and limited to". The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

It is the intent of the applicant(s) that all publications, patents and patent applications referred to in this specification are to be incorporated in their entirety by reference into the specification, as if each individual publication, patent or patent application was specifically and individually noted when referenced that it is to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated herein by reference in its/their entirety.

What is claimed is:

1. A pharmaceutical gripper module for grapping a single pill in a pharmaceutical dispensing machine, comprising:

a. an automated movable housing;

b. a gripper mounted on said automated movable housing for grabbing and activating a probe to pick up and move said single pill.

2. The pharmaceutical gripper module according to claim 1, wherein said gripper is connected to a suction system for activating said probe.

3. The pharmaceutical gripper module according to claim 1, wherein said probe comprises a grasping element disposed at the tip of said probe for picking said single pill.

4. The pharmaceutical gripper module according to claim 1, wherein said gripper picks up said single pill without the use of suction.

5. The pharmaceutical gripper module according to claim 1, further comprising a dispensing head.

6. The pharmaceutical gripper module according to claim 1, further comprising one or more actuators for providing linear movements to said gripper in relation to said automated movable housing.

7. The pharmaceutical gripper module according to claim 1, further comprising one or more actuators for providing rotational movements to said gripper in relation to said automated movable housing.

8. The pharmaceutical gripper module according to claim 1, further comprising control circuitry for outputting dosage-manipulation signals to one or more actuators.

9. The pharmaceutical gripper module according to claim 1, wherein said pick up and move said single pill comprises manipulate said single pill out of a medication container.

10. The pharmaceutical gripper module according to claim 9, wherein said pick up and move said single pill comprises manipulate said single pill in a medication path, between said medication container and an opening of a medication receptacle.

11. The pharmaceutical gripper module according to claim 10, wherein said medication path comprises a total horizontal length of less than 20 cm.

12. The pharmaceutical gripper module according to claim 10, wherein said dispensing head comprises said medication receptacle.

13. The pharmaceutical gripper module according to claim 10, wherein said gripper does not move horizontally towards said medication receptacle after said pick up of said single pill.

14. A method of extracting a single pill from a medication container by a pharmaceutical gripper module, comprising:

a. grabbing a probe associated with said medication container by said gripper module;

b. activating said probe therefore grabbing said single pill;

c. extracting said grabbed single pill by extracting said probe from said medication container.

15. The method according to claim 14, wherein said grabbing comprises grasping said single pill by a grasping element disposed at a tip of said probe.

16. The method according to claim 14, wherein said grabbing is performed without suction.

17. The method according to claim 14, further comprising returning said probe into said medication container and releasing said probe within said medication container.

18. The method according to claim 14, wherein said grabbing a probe comprises coupling said gripper module to said probe.

19. The method according to claim 14, further comprising moving said pharmaceutical gripper module to proximate said medication container.

20. The method according to claim 14, further comprising checking if single pill was grabbed by activating a sensor.

21. The method according to claim 14, wherein said grabbing said single pill comprises grabbing said single pill by activating vacuum.

22. The method according to claim 21, further comprising checking if single pill was grabbed by measuring said vacuum.

23. The method according to claim 14, further comprising placing said extracted single pill in a medication receptacle.

24. The method according to claim 23, wherein said placing comprises releasing said extracted single pill.

25. The method according to claim 24, wherein said releasing comprises deactivating said activated vacuum.

* * * * *